US010993875B2

(12) United States Patent
Amici et al.

(10) Patent No.: US 10,993,875 B2
(45) Date of Patent: May 4, 2021

(54) TUB WITH SWIRL PORTS AND DISPENSER

(71) Applicant: Jacuzzi Inc., Chino Hills, CA (US)

(72) Inventors: Andrea Amici, Casarsa della Delizia (IT); Fabio Felisi, Milan (IT); Guido Grattoni, Porcia (IT); Erica A. Moir, Santa Ana, CA (US); Sara Massarutti, Fagagna (IT); Gianni Emanuele Stival, Fossalta di Portogruaro (IT)

(73) Assignee: Jacuzzi Inc., Chino Hills, CA (US)

( * ) Notice: Subject to any disclaimer, the term of this patent is extended or adjusted under 35 U.S.C. 154(b) by 70 days.

(21) Appl. No.: 16/563,284

(22) Filed: Sep. 6, 2019

(65) Prior Publication Data

US 2020/0078263 A1 Mar. 12, 2020

Related U.S. Application Data

(60) Provisional application No. 62/730,267, filed on Sep. 12, 2018.

(51) Int. Cl.
*A61H 33/00* (2006.01)
*A61H 33/04* (2006.01)

(52) U.S. Cl.
CPC ..... *A61H 33/0087* (2013.01); *A61H 33/04* (2013.01); *A61H 2033/048* (2013.01)

(58) Field of Classification Search
CPC ..... A61H 33/0087
USPC ..... 4/541.1, 538, 491, 493, 545, 668; 601/160
See application file for complete search history.

(56) References Cited

U.S. PATENT DOCUMENTS

| | | | |
|---|---|---|---|
| 3,967,323 | A | 7/1976 | Serio |
| 4,514,868 | A | 5/1985 | Visinand |
| 6,328,900 | B1 | 12/2001 | King |
| 6,405,387 | B1 | 6/2002 | Barnes |
| 6,461,498 | B2 | 10/2002 | Tseng |
| D470,579 | S | 2/2003 | Foster |
| 6,611,969 | B2 | 9/2003 | Collins et al. |
| 6,723,233 | B1 | 4/2004 | Barnes |
| 6,724,873 | B2 | 4/2004 | Senna Da Silva |
| 6,859,954 | B2 | 3/2005 | Collins et al. |
| 7,407,154 | B2 | 8/2008 | Sakakibara et al. |
| 7,818,826 | B2 | 10/2010 | Schmidt et al. |
| 7,875,173 | B1 | 1/2011 | Barnes |
| D709,598 | S | 7/2014 | Dupras |
| 8,847,913 | B2 | 9/2014 | Tempas et al. |
| 9,069,201 | B2 | 6/2015 | Pipitone et al. |
| 9,248,075 | B2 | 2/2016 | Spencer et al. |
| 9,259,374 | B2 | 2/2016 | Castellote et al. |

(Continued)

FOREIGN PATENT DOCUMENTS

| | | |
|---|---|---|
| EP | 3195772 A1 | 7/2017 |
| FR | 2478702 A1 | 9/1981 |

*Primary Examiner* — Lori L Baker
(74) *Attorney, Agent, or Firm* — The Webb Law Firm

(57) ABSTRACT

A bathtub assembly includes a bathtub shell containing a volume of liquid, a circulation system in communication with the shell for creating a flow of liquid to and from the shell, and a dispenser assembly for introducing a substance into a portion of the flow of liquid into the bathtub shell. A control panel is rotatably mounted on an upper rim of the bathtub shell proximate to an inlet to the dispenser assembly and rotates to alternately cover or expose the inlet. A plurality of directed flow jets are connected to the bathtub shell for conveying the flow of liquid into the shell to create a directed flow of liquid within the bathtub shell.

20 Claims, 29 Drawing Sheets

(56) References Cited

U.S. PATENT DOCUMENTS

| | | | |
|---|---|---|---|
| 9,549,871 | B2 | 1/2017 | Campbell |
| 10,132,063 | B2 | 11/2018 | Nagayanagi et al. |
| 2004/0168248 | A1 | 9/2004 | Mattson, Jr. et al. |
| 2006/0002105 | A1 | 1/2006 | Hinojosa, Jr. |
| 2009/0271921 | A1 | 11/2009 | Castellote |
| 2010/0187326 | A1 | 7/2010 | Paroonagian et al. |
| 2011/0107513 | A1 | 5/2011 | Tjia |
| 2014/0157512 | A1 | 6/2014 | Yanity |
| 2014/0259358 | A1 | 9/2014 | Drury et al. |
| 2014/0338115 | A1 | 11/2014 | Sadler |
| 2017/0017315 | A1 | 1/2017 | Laflamme et al. |

TUB WITH SWIRL PORTS AND DISPENSER

CROSS REFERENCE TO RELATED APPLICATIONS

The present application claims priority to U.S. Provisional Patent Application No. 62/730,267, filed on Sep. 12, 2018, which is incorporated herein by reference in its entirety.

BACKGROUND OF THE INVENTION

Field of the Invention

The present invention relates to a bathtub assembly with water circulation features and, in particular, to a bathtub assembly that dispenses a substance into the tub and creates a directed flow of water within the tub.

Description of Related Art

Bathtubs incorporating various therapeutic and/or recreational features, such as spa jets for massage and aeration and associated circulation systems, are known in the art and are becoming increasingly popular in the market. Such massage/aeration jets are typically similar to jets utilized in larger spa tubs and are forceful. Also, the circulation systems utilized to create flow through the jets can be loud. As a result, while these systems offer desirable therapeutic and recreational advantages, the noise and turbulence created by these systems may not be found to be relaxing or soothing by some users and may detract from the overall bathing experience for some users.

Also, the use of therapeutic substances, such as Epsom salts, herb salts, aromatherapy, and essences to provide mental or physical benefits to the user and to contribute to the overall bathing experience is known in the art. Frequently, these substances are simply dispersed or poured by the user into the bath, which results in delayed and uneven dissolution and distribution of the substances. Dispenser assemblies for certain substances are also available, but such dispensers typically involve mechanisms that pour or disperse the substances directly into the bath as the user would.

SUMMARY OF THE INVENTION

According to an example of the present disclosure, a bathtub assembly is provided that enhances the soothing and relaxation benefits of the bathing experience. The bathtub assembly incorporates a water circulation system and directed flow nozzles for creating a directed flow or stream of water within the bath for soothing hydromassage and relaxation; a dispenser assembly that provides for the addition, dissolution and/or mixing, and distribution of therapeutic substances directly into the bath through use of the water circulation system and via a soothing and relaxing waterfall assembly; and various lighting features for further enhancing the soothing and relaxation benefits of the bathing experience. The bathtub assembly also includes simple controls for operating the water circulation, dispenser, and lighting functions of the bathtub assembly. The controls may be incorporated into a touchscreen panel mounted on the bathtub assembly.

According to a particular example of the present disclosure, a bathtub assembly is provided. The bathtub assembly includes a bathtub shell defining an interior cavity configured to contain a volume of liquid, the bathtub shell comprising an upper rim at least partially surrounding the interior cavity and having at least one dispenser flow opening defined therein; a circulation system in communication with the interior cavity of the bathtub shell, the circulation system being configured to create a flow of the liquid to and from the interior cavity of the bathtub shell; a housing in fluid communication between the circulation system and the interior cavity of the bathtub shell, the housing being connected to the bathtub shell at the at least one dispenser flow opening and configured to convey at least a portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the at least a portion of the flow of the liquid conveyed to the at least one dispenser flow opening such that the substance is introduced into the volume of liquid in the interior cavity of the bathtub shell via the at least one dispenser flow opening and the dispenser assembly comprising a dispenser inlet disposed in the upper rim of the bathtub shell configured to provide access for placing the substance in the dispenser assembly; and a control panel configured to be operated to control the circulation system, the control panel being disposed on the upper rim of the bathtub shell adjacent to the dispenser inlet, the control panel being rotatably connected to the upper rim between a position exposing the dispenser inlet and a position covering the dispenser inlet.

According to another particular example of the present disclosure, a bathtub assembly is provided. The bathtub assembly includes a bathtub shell defining an interior cavity configured to contain a volume of liquid, the bathtub shell having at least one dispenser flow opening and a plurality of directed flow openings defined therein; a circulation system in communication with the interior cavity of the bathtub shell, the circulation system being configured to create a flow of the liquid to and from the interior cavity of the bathtub shell; a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell; a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing.

According to another particular example of the present disclosure, a method of operating a bathtub assembly is provided. The method includes providing a bathtub assembly. The bathtub assembly includes a bathtub shell defining an interior cavity configured to contain a volume of liquid, the bathtub shell having at least one dispenser flow opening and a plurality of directed flow openings defined therein; a circulation system in communication with the interior cavity of the bathtub shell, the circulation system being configured to create a flow of the liquid to and from the interior cavity of the bathtub shell; a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell; a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing. The method further includes filling the interior cavity of the bathtub shell with the volume of liquid; inserting the substance into the dispenser assembly; activating the circulation system to create the flow of the liquid to and from the interior cavity of the bathtub shell through the directed flow jets to form the directed flow of the liquid within the interior cavity of the bathtub shell; and operating the valve to allow the second portion of the flow of the liquid to pass through the dispenser assembly, the housing, and the at least one dispenser flow opening to introduce the substance to the volume of liquid in the interior cavity of the bathtub shell via the at least one dispenser flow opening.

Further preferred and non-limiting embodiment or aspects will now be described in the following numbered clauses.

Clause 1: A bathtub assembly comprising: a bathtub shell defining an interior cavity configured to contain a volume of liquid, the bathtub shell comprising an upper rim at least partially surrounding the interior cavity and having at least one dispenser flow opening defined therein; a circulation system in communication with the interior cavity of the bathtub shell, the circulation system being configured to create a flow of the liquid to and from the interior cavity of the bathtub shell; a housing in fluid communication between the circulation system and the interior cavity of the bathtub shell, the housing being connected to the bathtub shell at the at least one dispenser flow opening and configured to convey at least a portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the at least a portion of the flow of the liquid conveyed to the at least one dispenser flow opening such that the substance is introduced into the volume of liquid in the interior cavity of the bathtub shell via the at least one dispenser flow opening and the dispenser assembly comprising a dispenser inlet disposed in the upper rim of the bathtub shell configured to provide access for placing the substance in the dispenser assembly; and a control panel configured to be operated to control the circulation system, the control panel being disposed on the upper rim of the bathtub shell adjacent to the dispenser inlet, the control panel being rotatably connected to the upper rim between a position exposing the dispenser inlet and a position covering the dispenser inlet.

Clause 2: The bathtub assembly according to clause 1, wherein the at least one dispenser flow opening comprises a waterfall opening and the bathtub assembly further comprises a waterfall plenum chamber in fluid communication with the dispenser assembly and the housing, and wherein the dispenser assembly, waterfall plenum chamber, the housing, and the waterfall opening are configured to form the at least a portion of the flow of the liquid into a waterfall as the at least a portion of the flow of the liquid passes through the waterfall opening into the interior cavity of the bathtub shell.

Clause 3: The bathtub assembly according to clause 1 or clause 2, wherein the bathtub shell has a plurality of directed flow openings defined therein, and wherein the bathtub assembly further comprises a plurality of directed flow jets in fluid communication between the circulation system and the interior cavity of the bathtub shell, the plurality of directed flow jets being configured to convey at least another portion of the flow of the liquid created by the circulation system into the interior cavity of the bathtub shell through the plurality of directed flow openings to create a directed flow of the liquid within the interior cavity of the bathtub shell, each of the plurality of directed flow jets comprising a flange directly affixed to an exterior surface bathtub shell at least one of the plurality of directed flow openings in the bathtub shell.

Clause 4: The bathtub assembly according to any one of clauses 1-3, further comprising a valve positioned in the circulation system, the valve being configured to be operated to allow the at least a portion of the flow of the liquid created by the circulation system to be directed to the dispenser assembly and the housing.

Clause 5: The bathtub assembly according to any one of clauses 1-4, further comprising a plurality of light features, the control panel being configured to operate the lighting features.

Clause 6: A bathtub assembly, comprising: a bathtub shell defining an interior cavity configured to contain a volume of liquid, the bathtub shell having at least one dispenser flow opening and a plurality of directed flow openings defined therein; a circulation system in communication with the interior cavity of the bathtub shell, the circulation system being configured to create a flow of the liquid to and from the interior cavity of the bathtub shell; a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell; a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing.

Clause 7: The bathtub assembly according to clause 6, wherein the at least one dispenser flow opening comprises a waterfall opening and the bathtub assembly further comprises a waterfall plenum chamber in fluid communication with the dispenser assembly and the housing, and wherein the dispenser assembly, waterfall plenum chamber, the housing, and the waterfall opening are configured to form the second portion of the flow of the liquid into a waterfall as the second portion of the flow of the liquid passes through the waterfall opening into the interior cavity of the bathtub shell.

Clause 8: The bathtub assembly according to clause 6 or clause 7, further comprising a control panel configured to be operated to control the circulation system and the valve, the control panel being rotatably connected to an upper rim of the bathtub shell, wherein the dispenser assembly comprises a dispenser inlet disposed in the upper rim of the bathtub shell adjacent to the control panel and configured to provide access for placing the substance in the dispenser assembly, and wherein the control panel is rotatable on the upper rim between a position exposing the dispenser inlet and a position covering the dispenser inlet.

Clause 9: The bathtub assembly according to clause 8, further comprising a plurality of lighting features, wherein the control panel is configured to be operated to activate the lighting features and to adjust a color and intensity of light emitted by the lighting features.

Clause 10: The bathtub assembly according to clause 9, wherein the lighting features comprise a plurality of light-emitting diodes disposed on the plurality of directed flow jets and at least one light-emitting diode disposed on the control panel.

Clause 11: The bathtub assembly according to any one of clauses 8-10, wherein the control panel is provided as an extractable unit removably assembled on the bathtub shell.

Clause 12: The bathtub assembly according to any one of clauses 6-11, wherein each of the plurality of directed flow jets comprises a flange directly affixed to an exterior surface bathtub shell at least one of the plurality of directed flow openings in the bathtub shell.

Clause 13: The bathtub assembly according to clause 12, wherein each of the plurality of directed flow jets further comprises an outlet disposed in a respective one of the plurality of directed flow openings and extending flush with an interior surface of the bathtub shell.

Clause 14: The bathtub assembly according to any one of clauses 6-13, wherein the plurality of directed flow jets are configured to direct the directed flow of the liquid within the interior cavity to form a swirling or circulating motion of the liquid within the interior cavity.

Clause 15: The bathtub assembly according to any one of clauses 6-14, wherein the dispenser assembly comprises a porous holder configured to contain the substance therein.

Clause 16: A method of operating a bathtub assembly, comprising: providing a bathtub assembly comprising: a bathtub shell defining an interior cavity configured to contain a volume of liquid, the bathtub shell having at least one dispenser flow opening and a plurality of directed flow openings defined therein; a circulation system in communication with the interior cavity of the bathtub shell, the circulation system being configured to create a flow of the liquid to and from the interior cavity of the bathtub shell; a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell; a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening; a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing; filling the interior cavity of the bathtub shell with the volume of liquid; inserting the substance into the dispenser assembly; activating the circulation system to create the flow of the liquid to and from the interior cavity of the bathtub shell through the directed flow jets to form the directed flow of the liquid within the interior cavity of the bathtub shell; and operating the valve to allow the second portion of the flow of the liquid to pass through the dispenser assembly, the housing, and the at least one dispenser flow opening to introduce the substance to the volume of liquid in the interior cavity of the bathtub shell via the at least one dispenser flow opening.

Clause 17: The method according to clause 16, wherein the bathtub assembly further comprises a control panel configured to be operated to control the circulation system and the valve, wherein the step of activating the circulation system comprises actuating a first control on the control panel for controlling the circulation system to create the flow of the liquid to and from the interior cavity, and wherein the step of operating the valve comprises actuating a second control on the control panel for controlling the valve to allow the second portion of the flow of the liquid to be directed to the dispenser assembly and the housing.

Clause 18: The method according to clause 17, wherein the control panel is rotatably connected to an upper rim of the bathtub shell, wherein the dispenser assembly comprises a dispenser inlet disposed in the upper rim of the bathtub shell adjacent to the control panel and configured to provide access for placing the substance in the dispenser assembly, and wherein the step of inserting the substance into the dispenser assembly comprises rotating the control panel to a position exposing the dispenser inlet, inserting the substances into the dispenser assembly via the dispenser inlet, and rotating the control panel to a position covering the dispenser inlet.

Clause 19: The method according to clause 17 or clause 18, wherein the bathtub assembly further comprises a plurality of lighting features and the control panel is configured to be operated to control the lighting features, and wherein the method further comprises actuating a third control on the control panel for controlling the lighting features to operate the lighting features and to adjust a color and intensity of light emitted by the lighting features.

Clause 20: The method according to any one of clauses 16-19, wherein the at least one dispenser flow opening comprises a waterfall opening and the bathtub assembly further comprises a waterfall plenum chamber in fluid communication with the dispenser assembly and the housing, and wherein the dispenser assembly, the waterfall plenum chamber, the housing, and the waterfall opening are configured to form the second portion of the flow of the liquid into a waterfall as the second portion of the flow of the liquid passes through the waterfall opening into the interior cavity of the bathtub shell.

Clause 21: A method of operating a bathtub assembly, comprising: providing a bathtub assembly according to any one of clauses 1-15; filling the interior cavity of the bathtub shell with the volume of liquid; inserting the substance into the dispenser assembly; activating the circulation system to create the flow of the liquid to and from the interior cavity of the bathtub shell through the directed flow jets to form the directed flow of the liquid within the interior cavity of the bathtub shell; and operating the valve to allow the second portion of the flow of the liquid to pass through the dispenser assembly, the housing, and the at least one dispenser flow opening to introduce the substance to the volume of liquid in the interior cavity of the bathtub shell via the at least one dispenser flow opening.

Clause 22: A bathtub assembly comprising: a bathtub shell defining an interior cavity configured to contain a volume of liquid, the bathtub shell having at least one waterfall opening defined therein proximate to a top of the interior cavity; a circulation system in communication with the interior cavity of the bathtub shell, the circulation system being configured to create a flow of the liquid to and from the interior cavity of the bathtub shell; a waterfall assembly in fluid communication between the circulation system and the interior cavity of the bathtub shell, the waterfall assembly being connected to the bathtub shell at the at least one waterfall opening and configured to convey at least a portion of the flow of the liquid created by the circulation system into the interior cavity of the bathtub shell through the at least one waterfall opening, the waterfall assembly and the at least one waterfall opening being configured to form the at least a portion of the flow of the liquid into a waterfall as the at least a portion of the flow of the liquid passes through the at least one waterfall opening into the interior cavity of the bathtub shell; and a dispenser assembly in fluid communication between the circulation system and the waterfall assembly, the dispenser assembly being configured to contain a substance therein and to expose the substance to the at least a portion of the flow of the liquid conveyed to the at least one waterfall opening such that the dissolvable therapeutic substance is introduced into the volume of liquid in the interior cavity of the bathtub shell via the waterfall.

Clause 23: A bathtub assembly comprising: a bathtub shell defining an interior cavity configured to contain a volume of liquid, the bathtub shell comprising an upper rim at least partially surrounding the interior cavity and having at least one flow opening defined therein; a circulation system in communication with the interior cavity of the bathtub shell, the circulation system being configured to create a flow of the liquid to and from the interior cavity of the bathtub shell; a housing in fluid communication between the circulation system and the interior cavity of the bathtub shell, the housing being connected to the bathtub shell at the at least one flow opening and configured to convey at least a portion of the flow of the liquid created by the circulation system into the interior cavity of the bathtub shell through the at least one flow opening; a dispenser assembly in fluid communication between the circulation system and the housing, the dispenser assembly being configured to contain a dissolvable therapeutic substance therein and to expose the dissolvable therapeutic substance to the at least a portion of the flow of the liquid conveyed to the at least one flow opening such that the dissolvable therapeutic substance is introduced into the volume of liquid in the interior cavity of the bathtub shell via the at least one flow opening and the dispenser assembly comprising a dispenser inlet disposed in the upper rim of the bathtub shell configured to provide access for placing the dissolvable therapeutic substance in the dispenser assembly; and a control panel configured to be operated to control the circulation system, the control panel being disposed on the upper rim of the bathtub shell adjacent to the dispenser inlet, the control panel being rotatably connected to the upper rim between a position exposing the dispenser inlet and a position covering the dispenser inlet.

Clause 24: A bathtub assembly comprising: a bathtub shell defining an interior cavity configured to contain a volume of liquid, the bathtub shell having a plurality of directed flow openings defined therein; a circulation system in communication with the interior cavity of the bathtub shell, the circulation system being configured to create a flow of the liquid to and from the interior cavity of the bathtub shell; and a plurality of directed flow jets in fluid communication between the circulation system and the interior cavity of the bathtub shell, the plurality of directed flow jets being configured to convey at least a portion of the flow of the liquid created by the circulation system into the interior cavity of the bathtub shell through the plurality of directed flow openings to create a directed flow of the liquid within the interior cavity of the bathtub shell, each of the plurality of directed flow jets comprising a flange directly affixed to an exterior surface bathtub shell at least one of the plurality of directed flow openings in the bathtub shell.

Clause 25: A method of operating a bathtub assembly, comprising: providing a bathtub assembly, comprising: a bathtub shell defining an interior cavity configured to contain a volume of liquid, the bathtub shell comprising an upper rim at least partially surrounding the interior cavity and at least one waterfall opening defined therein proximate to a top of the interior cavity; a circulation system in communication with the interior cavity of the bathtub shell, the circulation system comprising a pump configured to create a flow of the liquid to and from the interior cavity of the bathtub shell; a waterfall assembly in fluid communication between the circulation system and the interior cavity of the bathtub shell, the waterfall assembly being connected to the bathtub shell at the at least one waterfall opening and configured to convey at least a portion of the flow of the liquid created by the circulation system into the interior cavity of the bathtub shell through the at least one waterfall opening, the waterfall assembly and the at least one waterfall opening being configured to form the at least a portion of the flow of the liquid into a waterfall as the at least a portion of the flow of the liquid passes through the at least one waterfall opening into the interior cavity of the bathtub shell; a dispenser assembly in fluid communication between the circulation system and the waterfall assembly, the dispenser assembly being configured to contain a dissolvable therapeutic substance therein and to expose the dissolvable therapeutic substance to the at least a portion of the flow of the liquid conveyed to the at least one waterfall opening such that the dissolvable therapeutic substance is introduced into the volume of liquid in the interior cavity of the bathtub shell via the waterfall and the dispenser assembly comprising a dispenser inlet disposed in the upper rim of the bathtub shell configured to provide access for placing the dissolvable therapeutic substance in the dispenser assembly; an electronic valve positioned in the circulation system between the pump and the dispenser assembly; a plurality of directed flow jets in fluid communication between the circulation system and the interior cavity of the bathtub shell, the plurality of directed flow jets being configured to convey at least a portion of the flow of the liquid created by the circulation system into the interior cavity of the bathtub shell through the plurality of directed flow openings to create a directed flow of the liquid within the interior cavity of the bathtub shell; a plurality of lighting features; and a control panel in communication with the pump, the electronic valve, and the plurality of lighting features, the control panel comprising a plurality of controls for controlling the pump, the electronic valve, and the lighting features, the control panel being disposed on the upper rim of the bathtub shell adjacent to the dispenser inlet, the control panel being rotatably connected to the upper rim between a position exposing the dispenser inlet and a position covering the dispenser inlet; filling the interior cavity of the bathtub shell with the volume of liquid; rotating the control panel to the position exposing the dispenser inlet and inserting the dissolvable therapeutic substance in the dispenser assembly; rotating the control panel to the position covering the dispenser inlet; actuating the control on the control panel for controlling the pump to operate the pump to create the flow of the liquid to and from the interior cavity of the bathtub shell through the directed flow jets to form the directed flow of the liquid within the interior cavity of the bathtub shell; actuating the control on the control panel for controlling the electronic valve to operate the electronic valve to allow a portion of the liquid flow to and from the interior cavity of the bathtub shell to pass through the dispenser assembly and the waterfall assembly to form the waterfall and to introduce the dissolvable therapeutic substance to the volume of liquid in the interior cavity of the bathtub shell via the waterfall; and actuating the control on the control panel for controlling the lighting features to operate the lighting features and to adjust a color and intensity of light emitted by the lighting features.

Clause 26: The bathtub assembly according to any one of clauses 1-15 and 22-24 or the method according to any one of clauses 16-21 and 25, wherein the dispenser assembly is configured to receive any dissolvable or entrainable substance found to be suitable by those having ordinary skill in the art for use in connection with the bathtub assembly, wherein a dissolvable substance is a substance that, when exposed to the liquid flowing through the dispenser assembly, will dissolve in the liquid flow and be carried into the interior cavity of the inner shell by the flow of liquid passing through outlet housing and the at least one dispenser flow opening, wherein an entrainable substance is a substance that, when exposed to the liquid flowing through the dispenser assembly, will mix and/or blend with and thereby become entrained in the liquid flow and be carried into the interior cavity of the inner shell by the flow of liquid passing through the outlet housing and the at least one dispenser flow opening, wherein examples of such dissolvable and/or entrainable substances include bath salts, herbs, aromatherapy, essential oils, plant and flower extracts, cleaning agents, or combinations of such substances, wherein the substances may be provided and loaded into the dispenser tank in the form of powders, granular powders or crystals, liquids, tablets, soluble capsules or pods, etc, and wherein the substance may be provided in a sealed, pre-measured, disposable pod, cup, or container, and the dispenser tank and/or the strainer/basket may be provided with a piercing or cutting mechanism configured to couple with the disposable pod, cup, or container and pierce or cut the sealed disposable pod, cup, or container and thereby expose the substance within the sealed disposable pod, cup, or container to the flow of liquid through the dispenser assembly.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular forms of "a", "an", and "the" include plural referents unless the context clearly dictates otherwise.

DETAILED DESCRIPTION OF THE INVENTION

Figure 1:
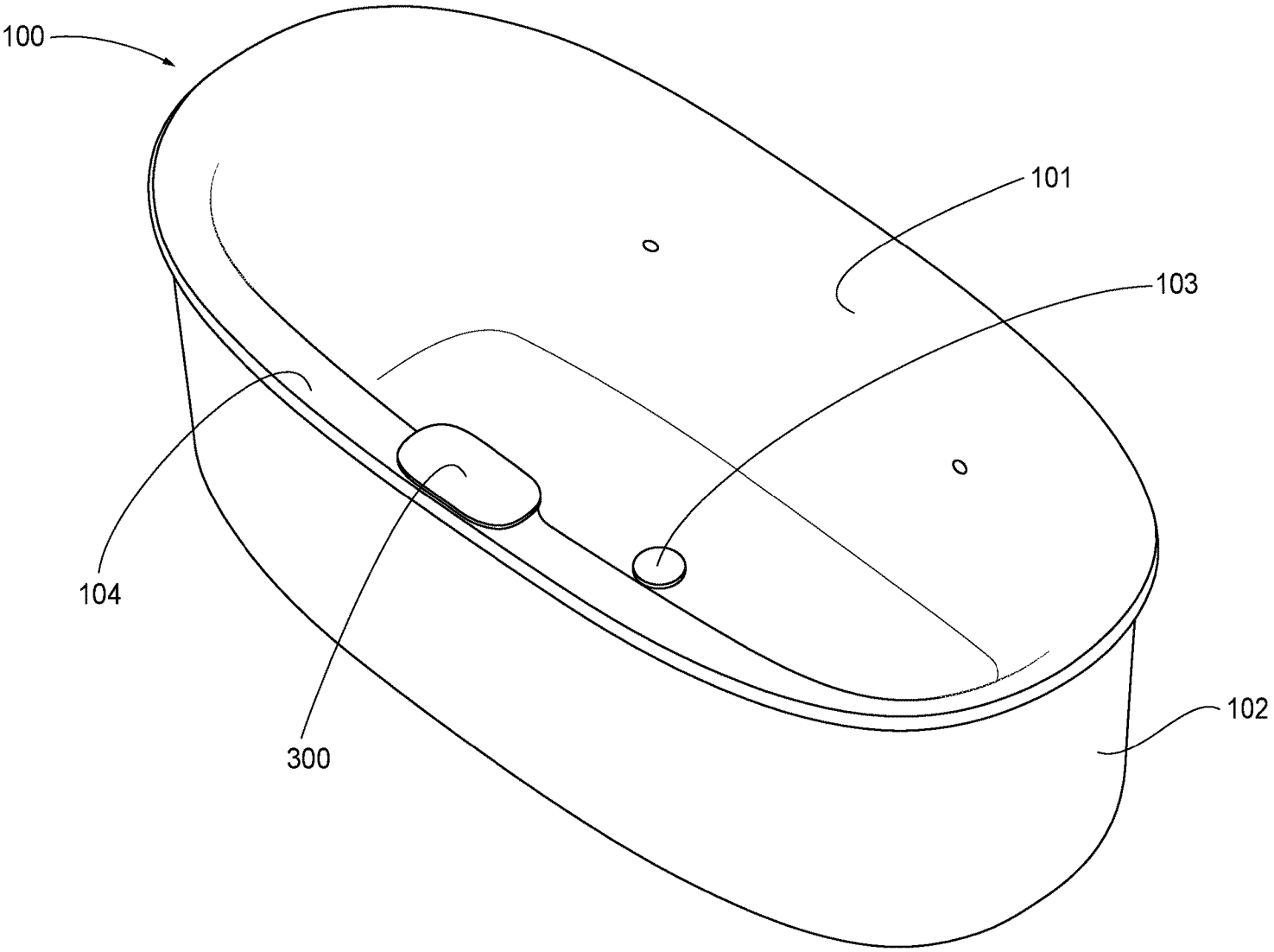
FIG. 1 is a perspective view of a bathtub assembly according to an example of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting.

I. System Overview

With reference to FIGS. 1-7, a bathtub assembly 100 is shown according to an example of the present disclosure. The bathtub assembly 100 includes an inner shell 101 and an outer shell 102. The inner shell 101 defines an interior cavity of the bathtub assembly 100 for containing a volume of liquid, in particular water, sufficiently large for a user to bathe in while fully or mostly immersed in the water. The assembly 100 includes a drain 103 in communication with the interior cavity of the inner shell 101 and connected to a drain pipe for draining the volume of liquid from the interior cavity after use of the bathtub assembly 100 is complete. The outer shell 102 defines the exterior of the bathtub assembly 100. According to an example of the present disclosure, the inner shell 101 and the outer shell 102 of the bathtub assembly 100 are made from a molded acrylic material. It is to be appreciated that the inner shell 101 and outer shell 102 may be made from any material known to be suitable to those having ordinary skill in the art. It is also to be appreciated that the inner shell 101 is disposed within the outer shell 102 and, as such, the exterior surface of the inner shell 101 and any internal components of the bathtub assembly 100 affixed to the exterior surface of the inner shell 101, as will be discussed below, will be hidden from view in the bathtub assembly 100.

It is to be appreciated that the bathtub assembly 100 may be utilized as an indoor bathtub as frequently found in home bathrooms. Alternatively, the bathtub assembly 100 may be a recreational spa assembly (i.e., "hot tub") configured for outdoor and/or indoor use, a portable tub assembly for use in homes, physical training facilities, and/or medical facilities, and/or a spa assembly configured for use in multiple applications.

Figure 2:
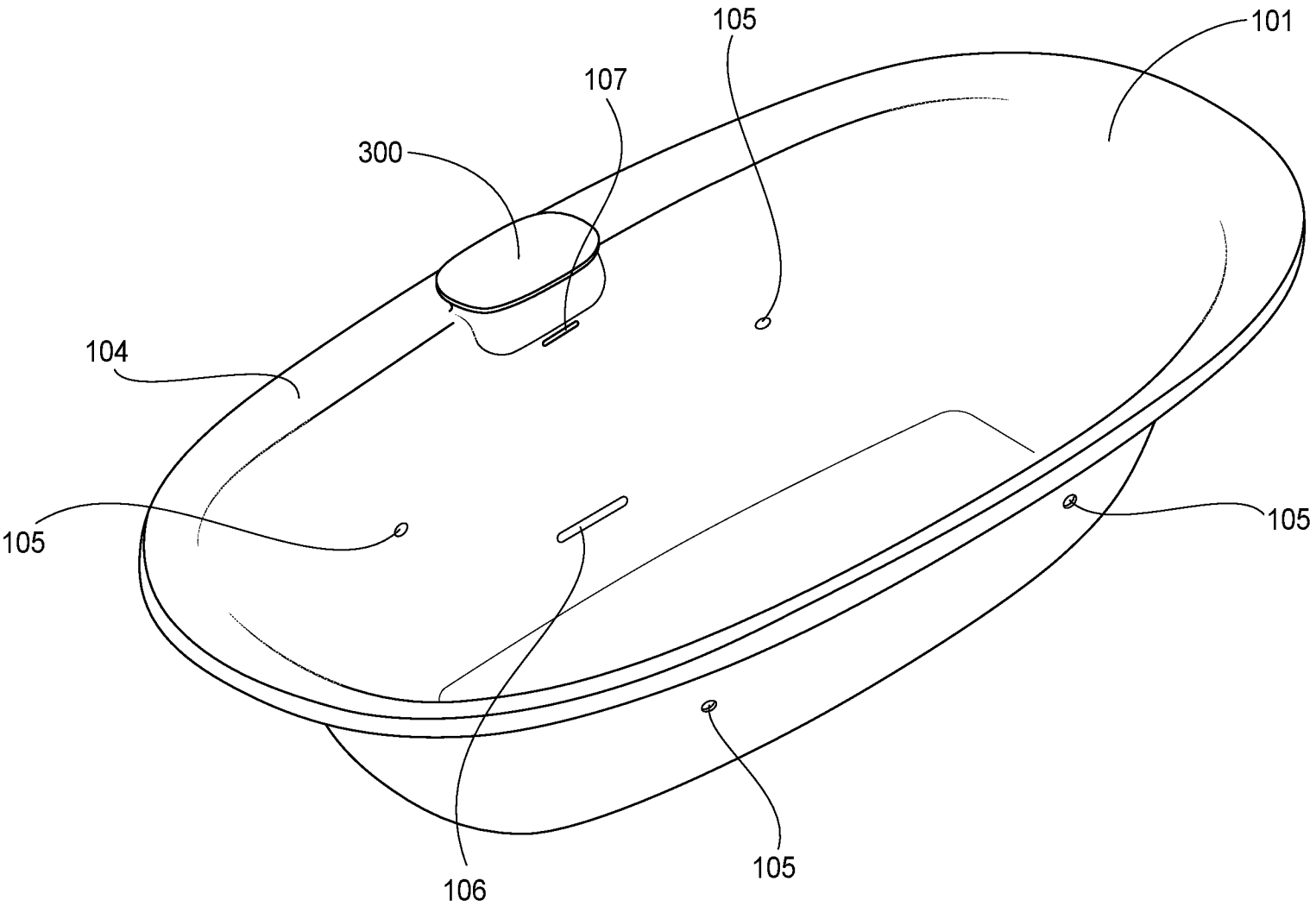
FIG. 2 is a perspective view of an inner shell of the bathtub assembly of FIG. 1.
Figure 3:
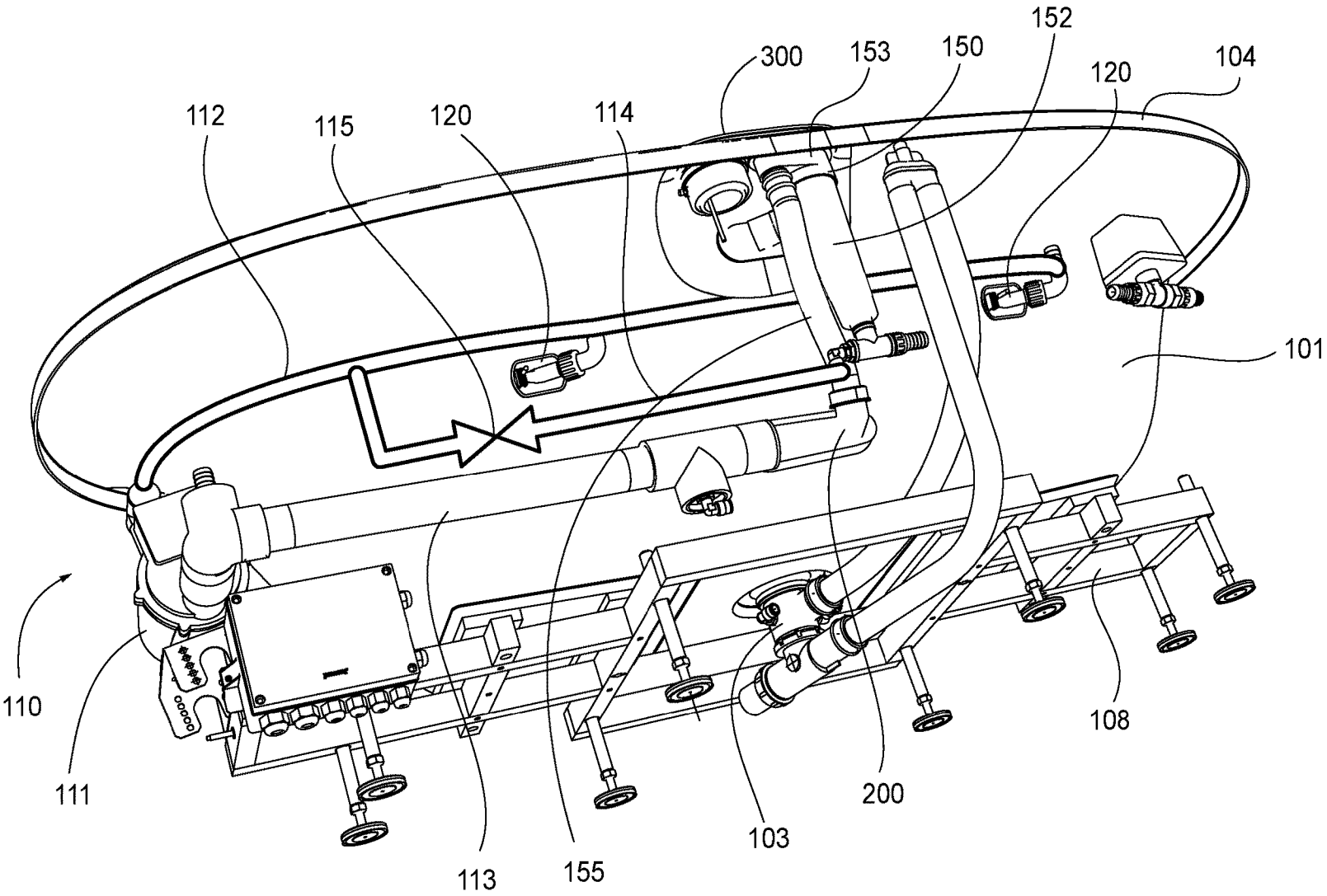
FIG. 3 is a perspective view of the inner shell and interior components of the bathtub assembly of FIG. 1.
Figure 6:
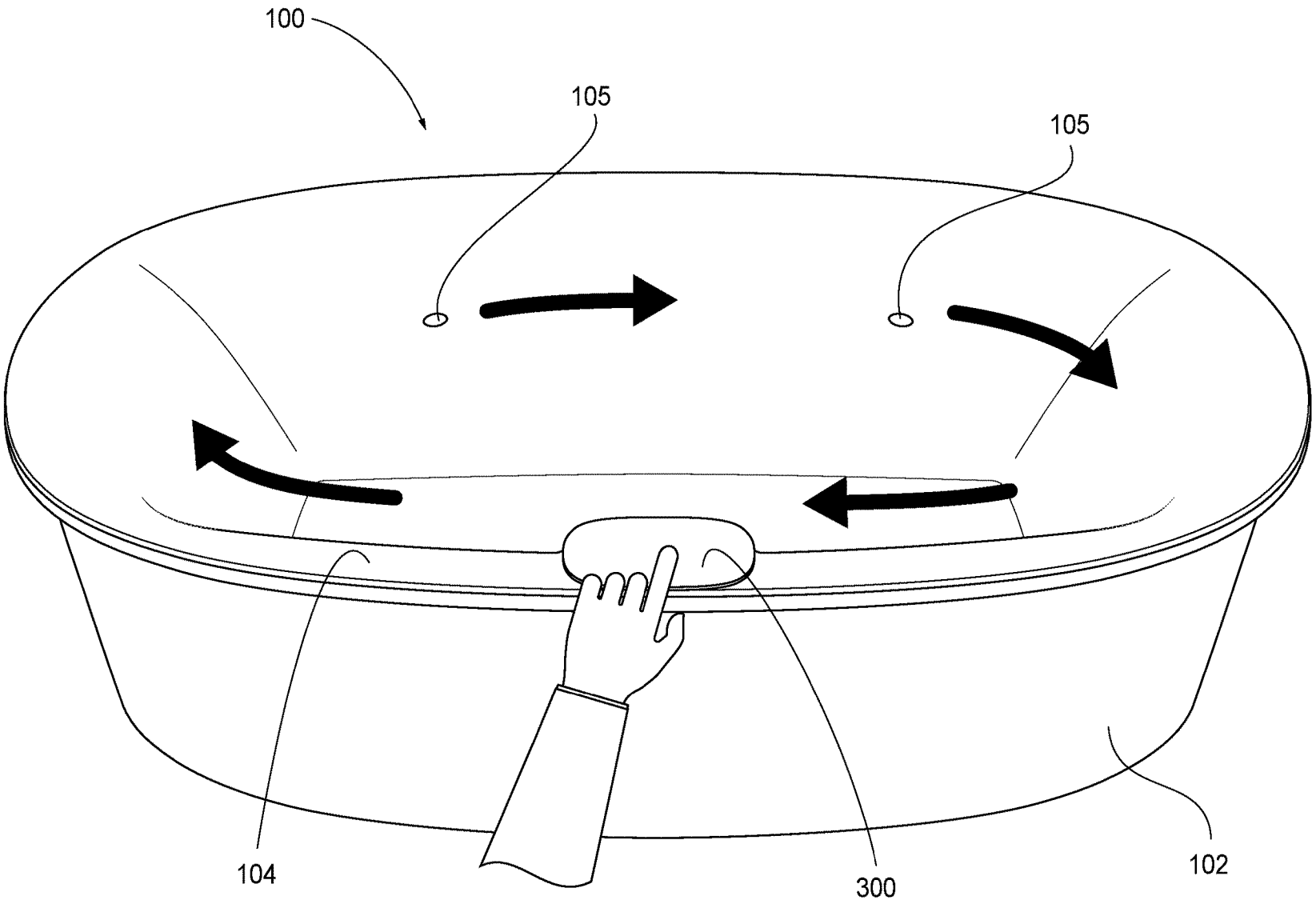
FIG. 6 is a perspective view of the bathtub assembly of FIG. 1 schematically illustrating a directed flow of liquid within the bathtub.
Figure 7:
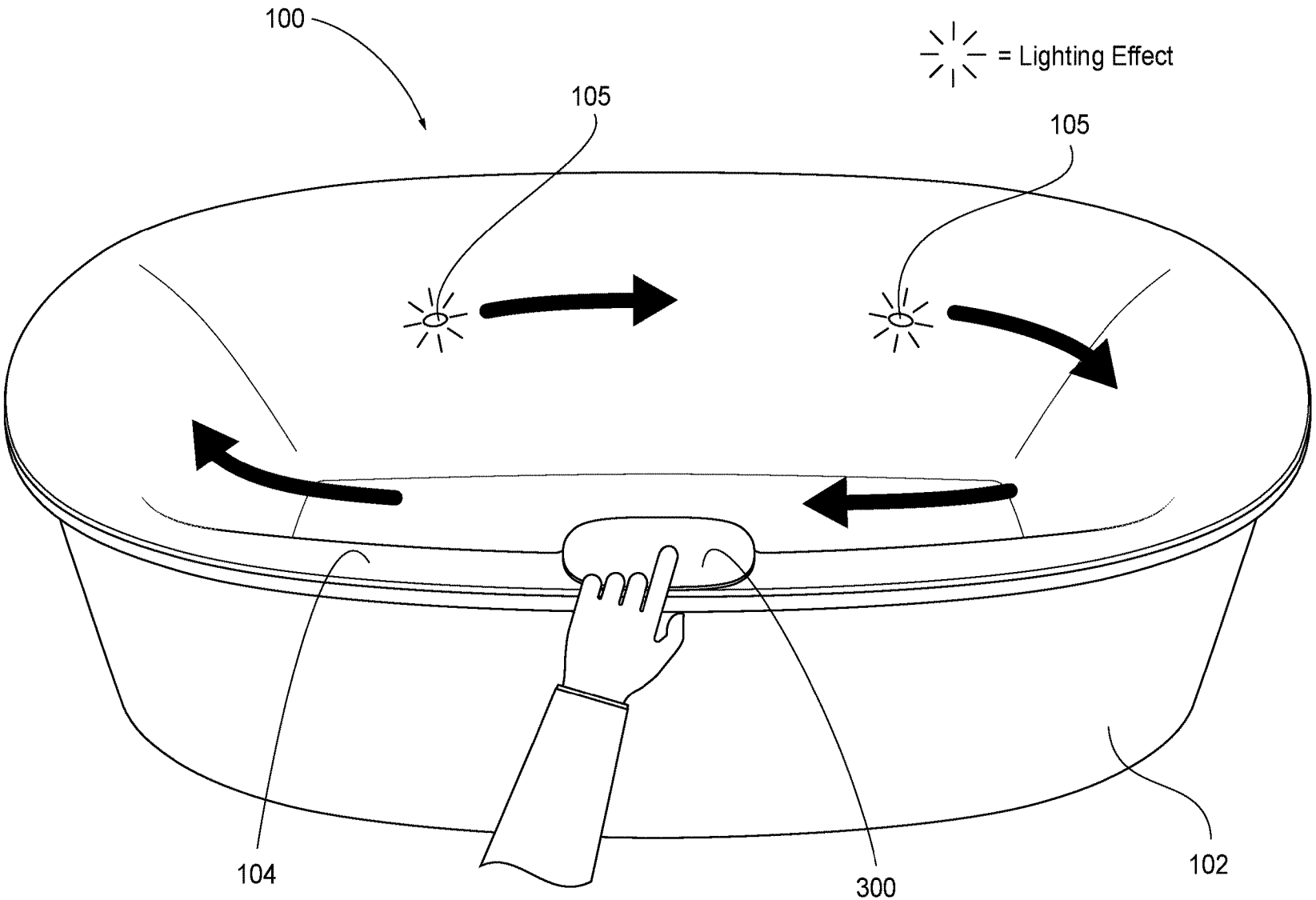
FIG. 7 is a perspective view of the bathtub assembly of FIG. 1 illustrating lighting features of the bathtub assembly and schematically illustrating the directed flow of liquid within the bathtub.
Figure 8:
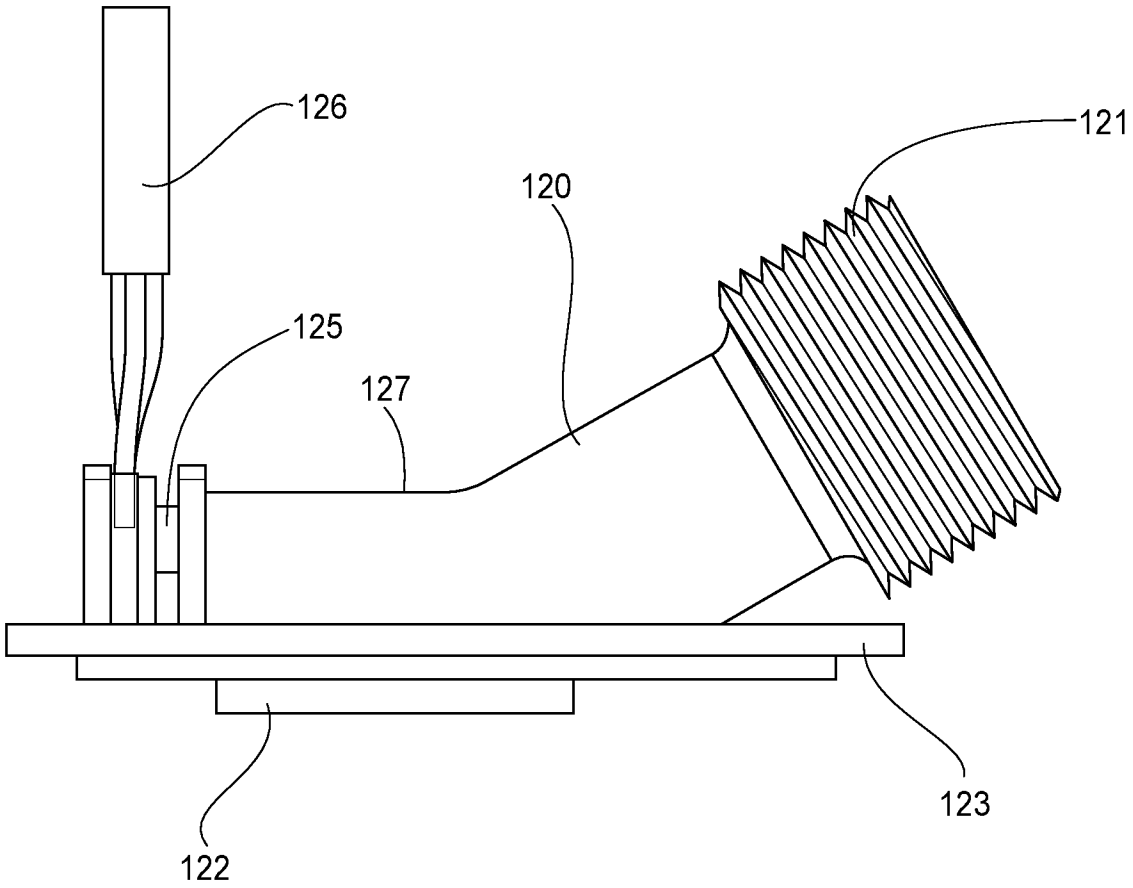
FIG. 8 is a top view of a directed flow jet of the bathtub assembly of FIG. 1.

As shown in FIGS. 2, 6, and 7, the inner shell 101 also includes an upper rim 104 at least partially surrounding the perimeter of the inner shell 101 and the interior cavity. According to one particular example, the upper rim 104 completely surrounds the perimeter of the inner shell 101 and the interior cavity. A plurality of directed flow openings 105 are formed in the inner shell 101 extending through the inner shell 101 from an exterior surface thereof to a surface of the interior cavity. The directed flow openings 105 provide for the communication of directed flow jets 120, shown in FIG. 3, with the interior cavity of the inner shell 101. The directed flow openings 105 are defined in the lateral sides of the inner shell 101 approximately midway along the height of the inner shell 101. As shown, there are four spaced directed flow openings 105 that may be provided as spaced sets of directed flow openings 105. At least one dispenser flow opening 107 or waterfall opening is also formed in the inner shell 101 approximately midway along the length of one of the lateral sides of the inner shell and proximate to the top of the interior cavity, i.e., slightly below the upper rim 104. The dispenser flow opening 107 provides for the communication of a dispenser and waterfall assembly 150, as shown in FIG. 3, with the interior cavity of the inner shell 101. According to the illustrated example, the dispenser flow opening 107 is positioned directly below a control panel 300. At least one suction opening 106 is also formed in the inner shell 101 directly below the dispenser flow opening 107. The suction opening 106 provides for the communication of a suction fitting/dispenser overflow drain 200, as shown in FIG. 3, with the interior cavity of the inner shell 101. It is to be appreciated that the size and shape of the inner shell 101 and the outer shell 102, as well as the size, shape, positioning, and arrangement of the above-mentioned openings 105, 106, 107, may be varied from the illustrated example in any manner found to be suitable to one having ordinary skill in the art.

With reference to FIG. 3, the bathtub assembly 100 may further include a support frame 108 positioned under the inner shell 101 and within the outer shell 102 for supporting the bathtub assembly 100 on a floor surface and distributing the weight of the bathtub assembly 100, the volume of liquid, and the user along the floor surface.

Figure 4:
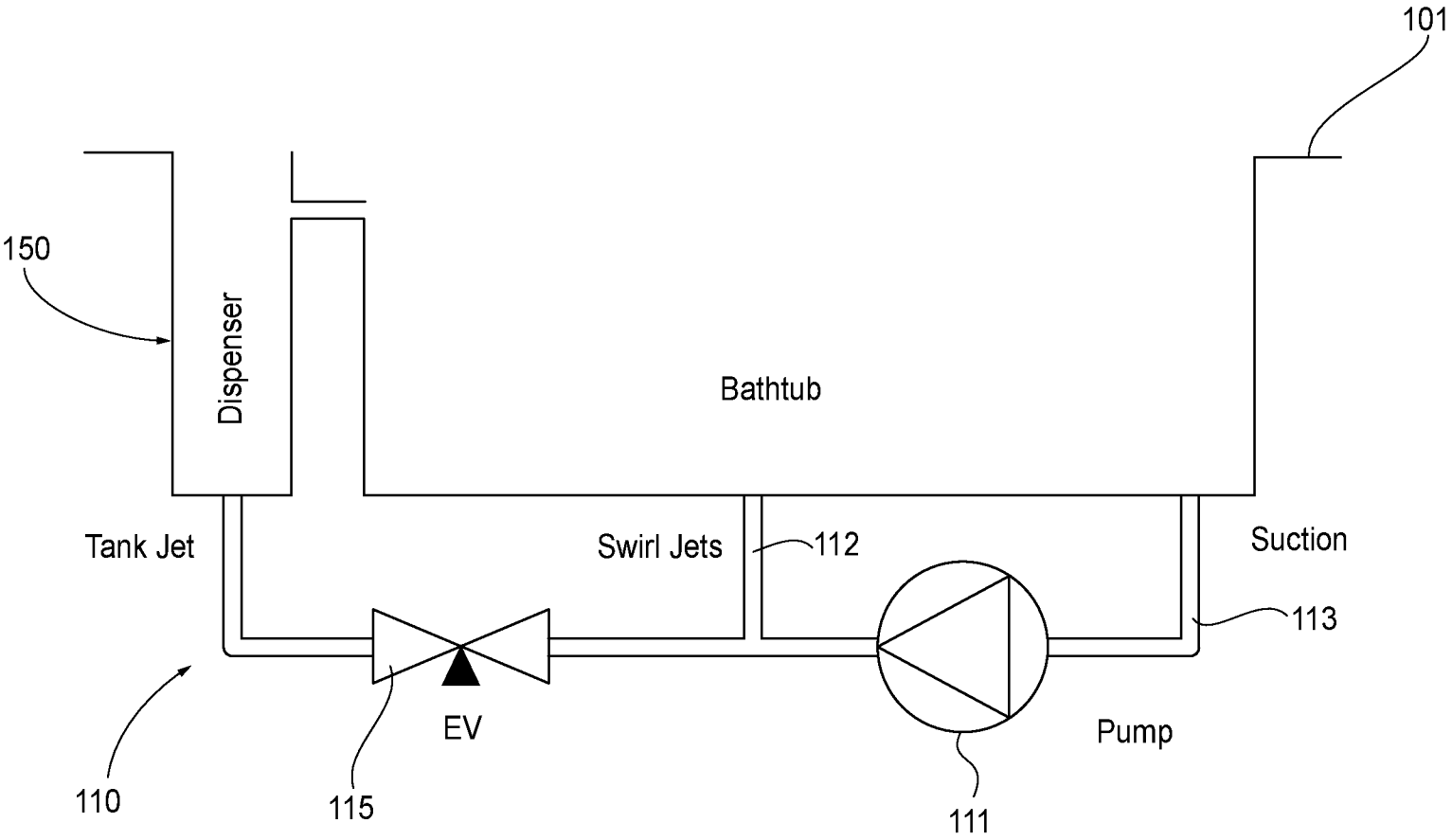
FIG. 4 is a schematic of the liquid circulation system of the bathtub assembly of FIG. 1.

With reference to FIGS. 3 and 4, the bathtub assembly 100 includes a circulation system 110 in communication with the interior cavity of the inner shell 101 via the above-mentioned openings 105, 106, 107. As will be discussed below, the circulation system 110 is configured to create a circulating flow of the liquid to and from the interior cavity of the inner shell 101. In particular, the circulation system 110 includes a pump 111 for creating a pressurized flow of the liquid within a piping system. The piping system includes a directed flow pipeline 112 for conveying the pressurized flow of liquid from the pump 111 to a plurality of directed flow jets 120, a suction pipeline 113 for conveying a return flow of the liquid from the interior cavity of the inner shell 101 to the pump 111 via a suction fitting/ dispenser overflow drain 200, and a dispenser pipeline 114 for conveying the pressurized flow of liquid from the pump 111 to a dispenser/waterfall assembly 150. According to an example of the present disclosure, the dispenser pipeline 114 is branched from the directed flow pipeline 112, and a valve 115 is provided for selectively controlling the flow of liquid to the dispenser/waterfall assembly 150. According to an example of the present disclosure, the valve 115 may be an electrically operated and remotely operable valve of any type found to be suitable to those having ordinary skill in the art.

According to an example of the present disclosure, the pump 111 operates silently or with minimal noise and without air compression, such that the only appreciable noise created by the circulation system 110 is the sound of flowing liquid moving into and around the interior cavity of the inner shell 101. According to another example of the present disclosure, the circulation system 110 also includes a heater (not shown) for heating or maintaining the temperature of the liquid as it is circulated to and from the interior cavity of the inner shell 101. According to an example of the present disclosure, the function of the pump 111 and the function of the heater may be adjusted according to the user's preferences.

With reference to FIGS. 1-3 and 5-7, the bathtub assembly 100 also includes a control panel 300 rotatably mounted on the upper rim 104 of the inner shell 101. As will be discussed further below, the control panel 300 includes a number of touchscreen controls 302, shown in FIGS. 27 and 28, that are operated by the user to control the circulation system 110 and the lighting features of the bathtub assembly 100, as will be discussed in further detail below. According to an example of the present disclosure, the control panel 300 is connected to the upper rim 104 adjacent to and directly above the dispenser flow opening 107. When activated via the control panel 300, the pump 111 will create a pressurized flow of the liquid through the directed flow pipeline 112 to the directed flow jets 120. Liquid is pulled from the interior cavity and returned to the pump 111 via the suction fitting/dispenser overflow drain 200 and the suction pipeline 113, such that a closed system of recirculated liquid is formed. As mentioned above, the circulation system 110 may include an inline heater for heating the recirculated flow of liquid. According to an example of the present disclosure, the pipelines 112, 113, 114 may include anti-bacterial additives for cleaning the liquid as the liquid is re-circulated.

As shown in FIGS. 6 and 7, the constant re-circulating flow of liquid into the interior cavity of the inner shell 101 via the directed flow jets 120 and out of the interior cavity of the inner shell 101 via the suction fitting/dispenser overflow drain 200 creates a directional flow of the liquid within the interior cavity. As will be discussed below, the directed flow jets 120 are further configured to angle the flow of liquid into the interior cavity along the sides of the inner shell 101 in a swirling or circulation motion to create a pleasing and relaxing stream of the liquid moving over and around the user. Thus, the directed flow of the liquid through the directed flow jets 120 offers a hydromassage benefit to the user without directly targeting a specific part of the user's body and without relying on powerful, turbulent jets of liquid or air and liquid. The speed/intensity of the directed flow of liquid may be set to the user's preference via a control incorporated in the control panel 300.

As shown in FIGS. 3-5, 12, and 13, the circulation system 110 also conveys the liquid to the dispenser/waterfall assembly 150 through the dispenser pipeline 114. Flow to the dispenser/waterfall assembly 150 is selectively controlled by the valve 115, which may be activated or de-activated to permit flow through the dispenser pipeline via a control incorporated in the control panel 300. The dispenser/waterfall assembly 150 provides for the dissolution, mixing, and/or entrainment and the subsequent distribution of substances, such as bath salts, herbs, aromatherapy, cleaning agents, or combinations of such substances, into the interior cavity of the inner shell 101 and for the creation of a flow of liquid carrying the substance or substances into the interior cavity of the inner shell in the form of a soothing, pleasant waterfall W. While the pump 111 is activated to create the directed flow of liquid into the interior cavity, the valve 115 is operated, via the control panel 300, to open flow through the dispenser pipeline 114 to the dispenser/waterfall assembly 150. The dispenser/waterfall assembly 150 is loaded with the substance by a user such that the flow of liquid into the dispenser/waterfall assembly 150 is mixed with the substance and is then directed into the interior cavity of the inner shell 101 by the dispenser/waterfall assembly 150 in the form of a waterfall W.

II. Directed Flow Jets

With reference to FIGS. 3 and 6-11, the bathtub assembly 100 includes a plurality of directed flow or "swirl" jets 120 distributed around the inner shell 101 and in fluid communication between the circulation system 110 and the interior cavity of the inner shell 101. The directed flow jets 120 convey at least a portion of the flow of the liquid created by the circulation system 110 into the interior cavity of the inner shell 101 through the plurality of directed flow openings 105 to create the directed flow of liquid within the interior cavity of the inner shell 101.

As shown in FIGS. 8-11, each directed flow jet 120 includes an inlet 121 connected to a branch of the directed flow pipeline 112 (shown in FIG. 3) and an outlet 122 that opens into the interior cavity of the inner shell 101. A flow passage 124 is defined in the directed flow jet 120 between the inlet 121 and the outlet 122. A flange 123 surrounds the outlet 122. The flange 123 is directly affixed to an exterior surface of the inner shell 101 at least one of the directed flow openings 105 in order to connect the directed flow jet 120 to the inner shell 101.

Figure 9:
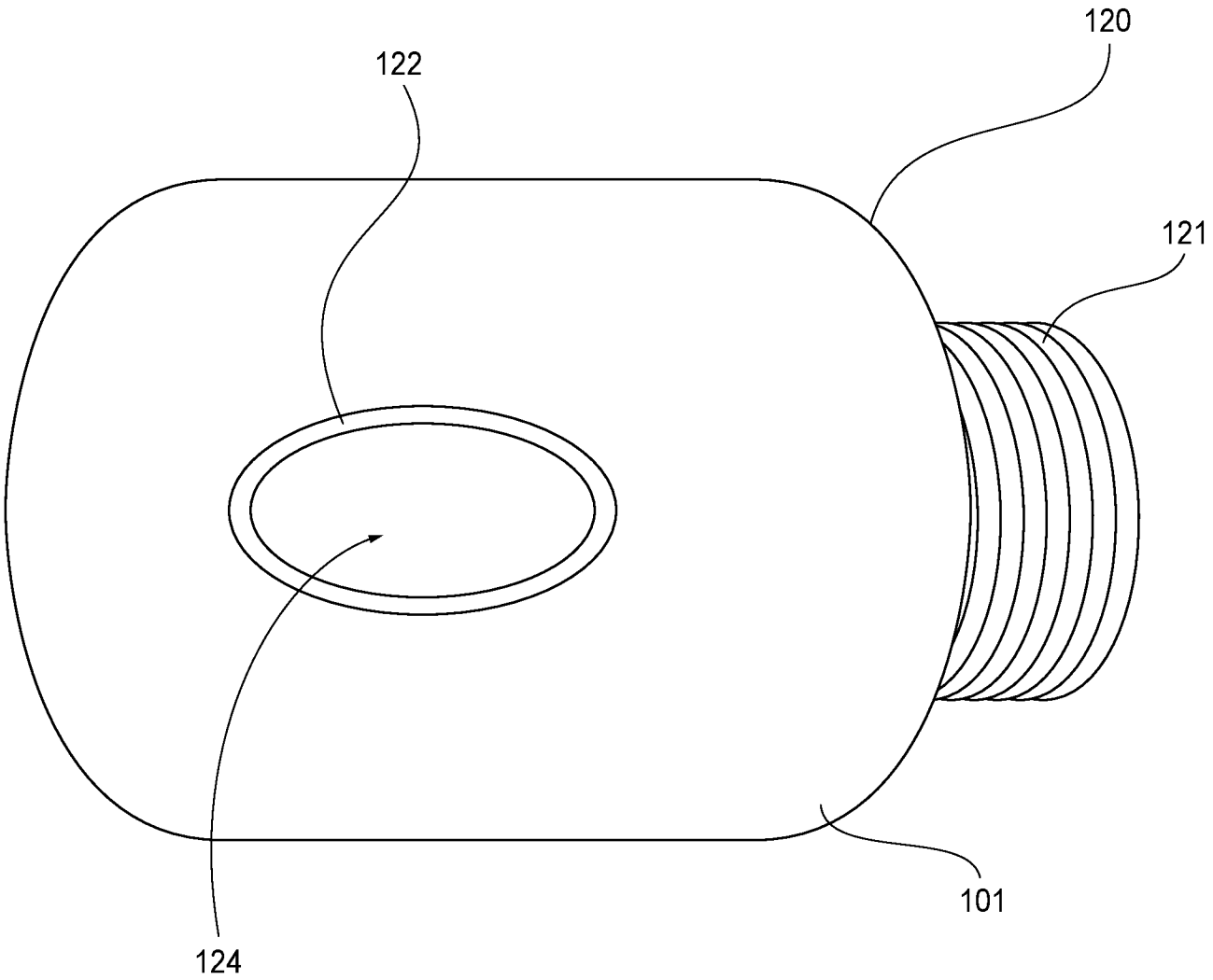
FIG. 9 is a front view of the directed flow jet of FIG. 8 connected to a portion of the inner shell of the bathtub assembly.
Figure 10:
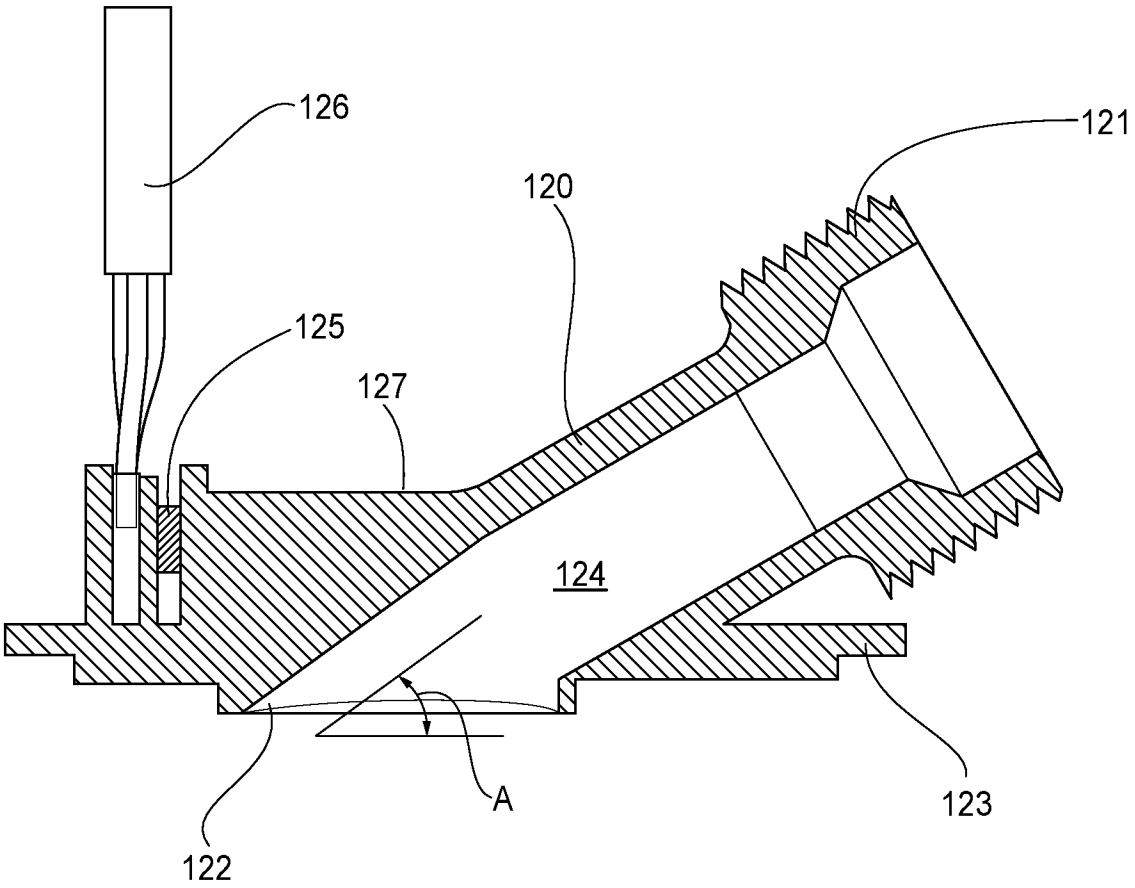
FIG. 10 is a cross-sectional view of the directed flow jet of FIG. 8.
Figure 11:
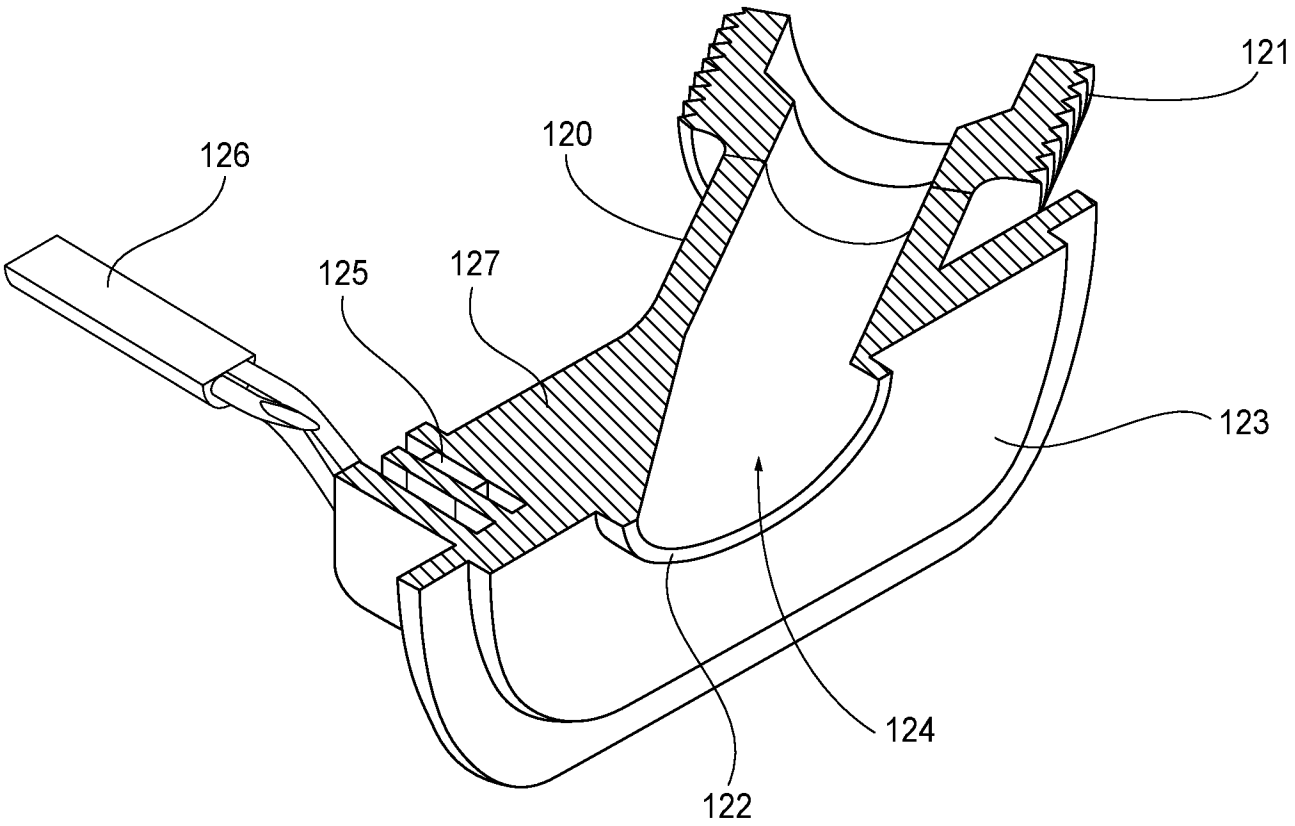
FIG. 11 is a perspective cross-sectional view of the directed flow jet of FIG. 8.

The flange 123 is offset from an end of the outlet 122, and the outlet 122 has a shape, such as an oval or elliptical shape, corresponding to the shape of the directed flow opening 105 such that the outlet 122 extends into the directed flow opening 105 and terminates flush with or substantially flush with the interior surface of the inner shell 101, as shown in FIG. 9, thus providing for direct fluid communication between the flow passage 124 and the interior cavity of the inner shell 101. The flow passage 124 extends at an angle A with respect to the flange 123 and the local portion of the inner shell 101 in order to form the directed flow of liquid within the interior cavity discussed above with reference to FIGS. 6 and 7. According to a particular example of the present disclosure, the angle A is approximately 15°-45°, more particularly approximately 25°-35°, and more particularly approximately 30° in order to form a directed flow of liquid at a corresponding angle within the interior cavity along the interior surface of the inner shell 101. It is to be appreciated that the angle A may be any angle found to be suitable to those having ordinary skill in the art for creating the directed flow of the liquid.

According to an example of the present disclosure, the flange 123 is adhered directly to an exterior surface of the inner shell 101 with a suitable adhesive, such as a silicon glue. The flange 123 may incorporate a channel extending around the perimeter thereof for holding a reservoir of the adhesive. It is to be appreciated that the directed flow jets 120 may be directly affixed to the exterior surface.

The directed flow jet 120 also includes an extension 127 protruding therefrom. The extension 127 supports a lighting device, such as an RGB LED 125. The RGB LED 125 may be connected to the bathtub assembly's power system and to the control panel 300 via wiring 126. According to an example of the present disclosure, the directed flow jets 120 are fully or partially formed from a transparent or translucent material, such as a transparent acrylic or polymer material, so that the directed flow jets 120 act as light guides for transmitting light from the RGB LED 125 into the interior cavity of the inner shell 101. When activated via the control panel 300, the RGB LEDs 125 provide backlighting to the directed flow jet visible from the interior cavity of the inner shell 101, as shown in FIG. 7, which creates a mood-lighting effect that further enhances the relaxation benefits of the bathing experience for the user. According to another example of the present disclosure, the RGB LEDs 125 can be activated to transmit light in different colors and at different intensities/brightness levels. The color and intensity of the light can be controlled by the user through the control panel 300. It is to be appreciated that the lighting devices associated with the directed flow jets 120 may be of any type found to be suitable to those having ordinary skill in the art.

As discussed above, the directed flow jets 120 are transparent or translucent to visible light in order to create a light guide to transmit the light emitted by the RGB LEDs 125. The RGB LEDs 125 may be synchronized with each other and with the lighting features provided with the control panel 300, as will be discussed below. The control panel 300 may include a dedicated touchscreen control 302 for controlling the color and brightness/intensity of all of the lighting features of the bathtub assembly 100. The flanges 123 of the directed flow jets 120 may be adhered, such as by an adhesive glue, directly to the exterior surface of the inner shell 101, such that the outlets 122 extend flush with or substantially flush with the interior surface of the inner shell 101 and only a thin oval or elliptical transparent boundary is visible from within the interior cavity. From the perspective of a user within the interior cavity, the directed flow jets 120 may appear as elliptical or oval holes in the inner shell 101, which can be backlit by the RGB LEDs 125.

III. Dispenser/Waterfall Assembly

With reference to FIGS. 3 and 12-24, the bathtub assembly 100 includes a dispenser/waterfall assembly 150 in fluid communication between the circulation system 110 and the interior cavity of the inner shell 101 via the at least one dispenser flow opening/waterfall opening 107 formed in the inner shell 101. The dispenser/waterfall assembly 150 includes a waterfall assembly, which includes a dispenser tank 152, a waterfall plenum chamber 153, and an outlet housing 157, in fluid communication between the circulation system 110 and the interior cavity of the inner shell 101. The outlet housing 157 is connected to an exterior surface of the inner shell 101 at the at least one dispenser flow opening 107. The dispenser tank 152, waterfall plenum chamber 153, and the outlet housing 157 are configured to convey at least a portion of the flow liquid created by the circulation system 110 into the interior cavity of the inner shell 101 through the at least one dispenser flow opening/waterfall opening 107. The waterfall assembly and the at least one dispenser flow opening/waterfall opening 107 are configured to form the at least a portion of the flow of the liquid into a waterfall W as the at least a portion of the flow of the liquid passes through the at least one waterfall opening 107 into the interior cavity of the inner shell 101.

The dispenser/waterfall assembly 150 also includes a dispenser assembly, which includes a dispenser inlet 151, the dispenser tank 152 and a strainer or basket 159 positioned within the dispenser tank 152. The dispenser tank 152 is in fluid communication between the circulation system 110, the waterfall plenum chamber 153, and the outlet housing 157. The dispenser tank 152 and strainer/basket 159 are configured to contain a substance therein and to expose the substance to the at least a portion of the flow of the liquid conveyed to the at least one dispenser flow opening 107 such that the substance is introduced into the volume of liquid in the interior cavity of the inner shell 101 via the waterfall W.

Figure 12:
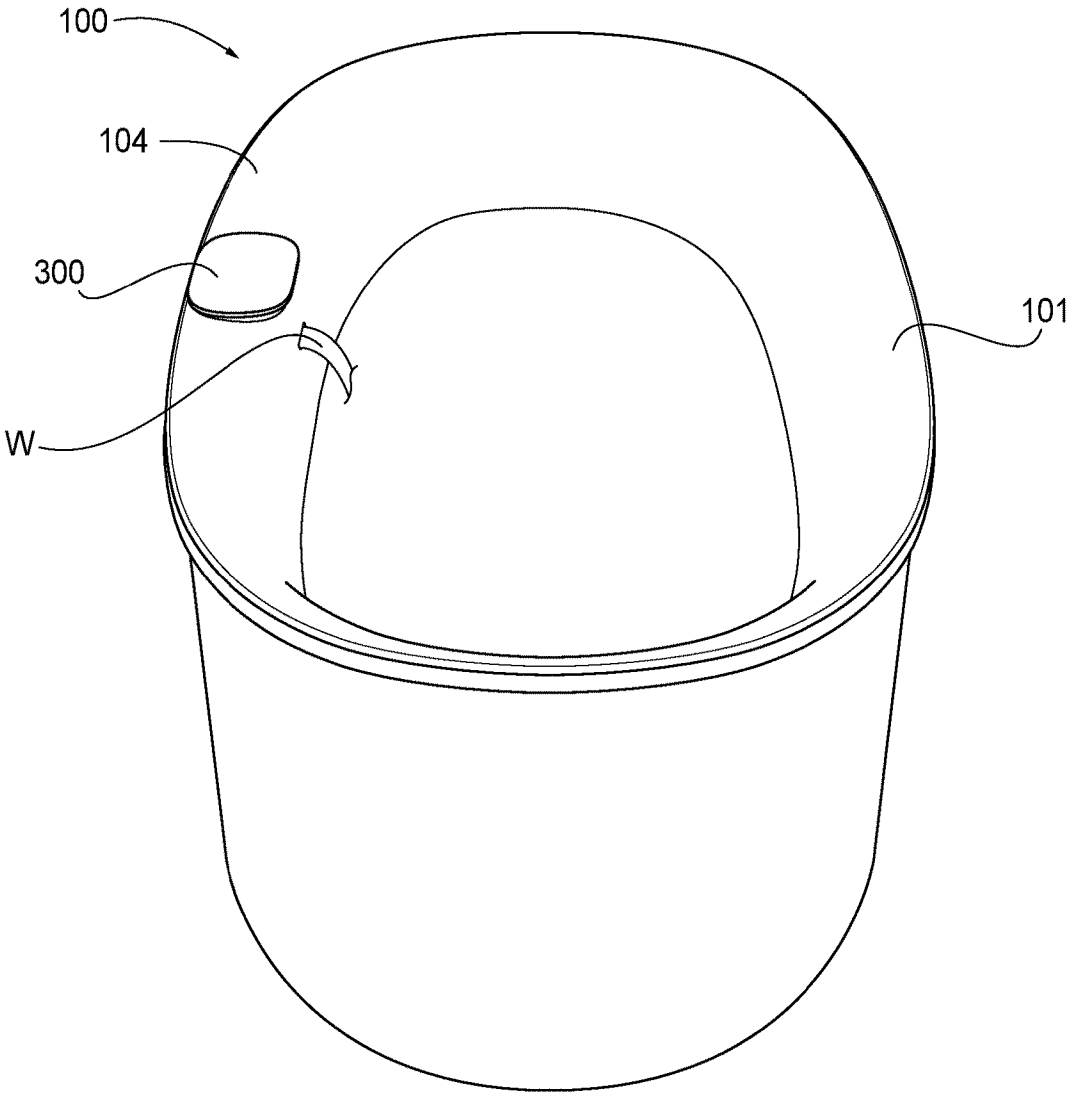
FIG. 12 is a perspective view of the bathtub assembly of FIG. 1 illustrating a waterfall feature of the bathtub assembly.

With reference to FIG. 12, the dispenser/waterfall assembly 150 forms the waterfall W in a non-pressurized manner by forming a plenum or reservoir of liquid above the height of the outlet housing 157 and the at least one dispenser flow opening 107. As can be readily appreciated by one having ordinary skill in the art, the containment of the liquid within the plenum creates a hydrostatic pressure above the at least one dispenser flow opening 107, which in turn generates the flow of liquid forming the waterfall W. In particular, the plenum is provided with a maximum liquid height level at a distance above the level of the at least one dispenser flow opening 107. The pressure created by the liquid held within the plenum causes liquid to flow out of the at least one waterfall opening 107 to form the waterfall W, which streams laterally from the at least one waterfall opening 107 into the interior cavity of the inner shell 101 and falls to the volume of liquid held within the interior cavity, which has a maximum level defined at a height below the level of the at least one waterfall opening 107. According to a particular example of the present disclosure, the maximum liquid height level of the plenum is defined as approximately 0.5-4 cm, more particularly approximately 1-3 cm, and more particularly approximately 2 cm above the level of the at least one dispenser flow opening 107. It is to be appreciated that the maximum height level, the level of the at least one dispenser flow opening 107, and the maximum level of the volume of liquid within the interior cavity may be set at any relative heights found to be suitable to those having ordinary skill in the art.

With reference to FIGS. 14-20, the dispenser/waterfall assembly 150 includes the dispenser tank 152, which includes a bottom inlet connected to the dispenser pipeline 114 to place the dispenser tank 152 in fluid communication with the circulation system 110, as discussed above. The dispenser tank 152 has a hollow interior defining a cavity for accommodating the strainer/basket 159 therein and for allowing liquid from the circulation system 110 to fill the dispenser tank 152 and circulate through the strainer/basket 159, thereby dissolving and/or entraining the substance contained in the strainer/basket 159 as the liquid flows through the dispenser tank 152 to the waterfall assembly. The strainer/basket 159 has a suitably porous structure to allow the liquid to flow through the strainer/basket 159 while retaining the substance within the dispenser tank 152. The strainer/basket 159 includes an external flange 160 at an upper end thereof. The external flange 160 engages the top of the dispenser tank 152 to retain the strainer/basket 159 in the interior of the dispenser tank 152.

The waterfall plenum chamber 153 is disposed at the top of the dispenser tank 152 and is in fluid communication with the top of the dispenser tank 152. The waterfall plenum chamber 153, in combination with the dispenser tank 152, defines the plenum for creating the waterfall W, as discussed above. The waterfall plenum chamber 153 includes an overflow drain outlet 154 that is separated from the inlet to the waterfall plenum chamber 153 by a divider wall 161. As liquid enters the waterfall plenum chamber 153 from the dispenser tank 152, it fills the waterfall plenum chamber 153 to the height of the divider wall 161, which defines the maximum liquid height level described above. If the liquid level rises above the divider wall 161, it flows over the divider wall 161 into the overflow drain outlet 154. The overflow drain outlet 154 is in communication with the suction fitting/dispenser overflow drain 200 via an overflow drain pipe 155 such that overflow liquid from the plenum is returned to the interior cavity of the inner shell 101 via the suction fitting/dispenser overflow drain 200 and the at least one suction opening 106.

The dispenser tank 152 also includes an outlet tube 156, which places the interior cavity of the dispenser tank 152 in communication with the outlet housing 157. The outlet tube 156 is disposed below the top of the dispenser tank 152 such that the top of the dispenser tank 152 and the waterfall plenum chamber 153 define the plenum extending to the height of the divider wall 161 above the outlet tube 156, which creates the liquid pressure causing liquid to flow out of the dispenser tank 152 through the outlet tube 156 and the outlet housing 157 and into the interior cavity of the inner shell 101 via the at least one dispenser flow opening/waterfall opening 107 in the form of the waterfall W. The outlet housing 157 may include a flange 158 at one end thereof for fastening the outlet housing 157 to the exterior surface of the inner shell 101 by an adhesive, such as silicon glue, or other suitable fastening mechanism. The flange 158 may incorporate a channel extending around the perimeter thereof for accommodating the adhesive.

Figure 5:
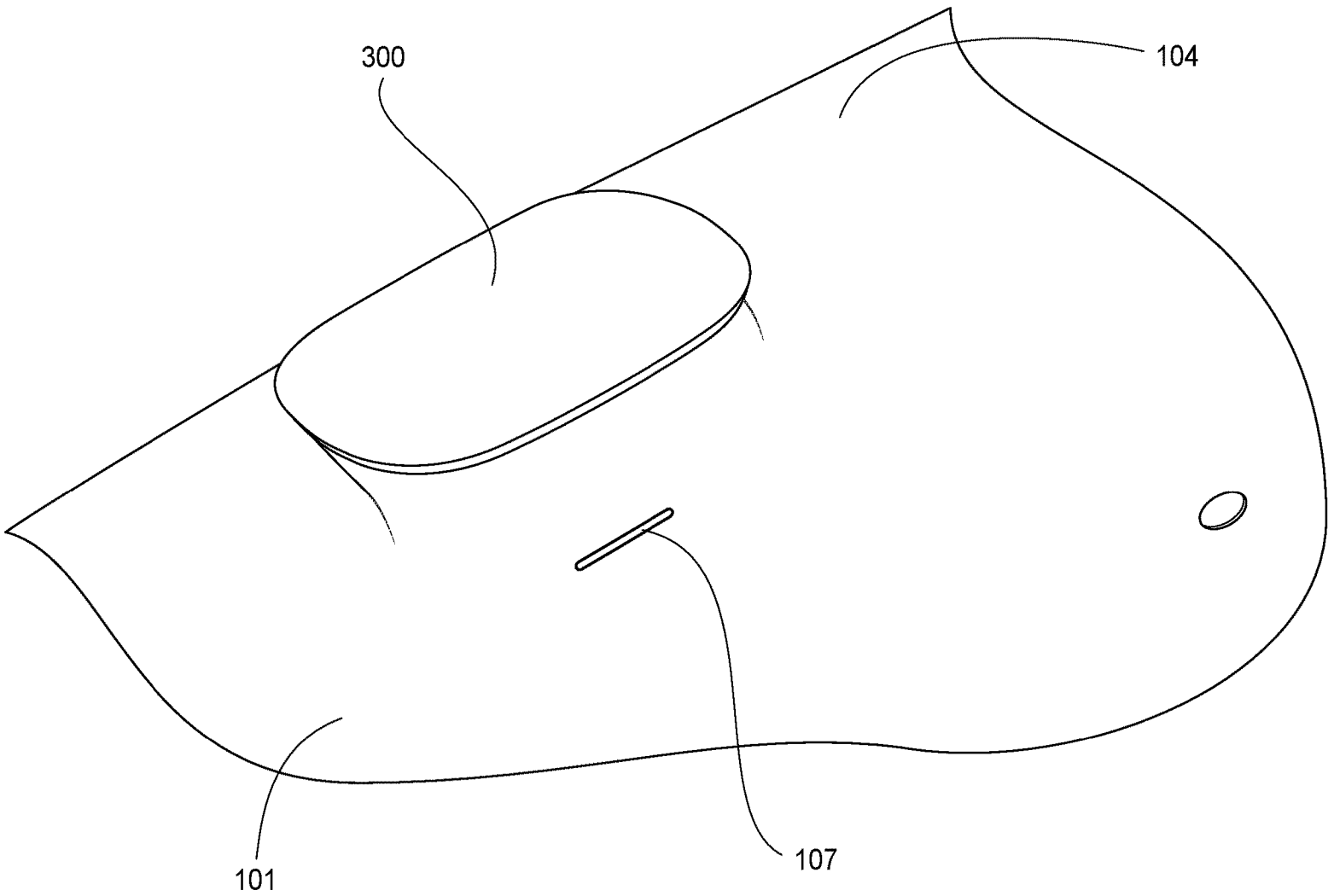
FIG. 5 is an enlarged perspective view of an upper rim, control panel, and waterfall outlet of the bathtub assembly of FIG. 1.
Figure 13:
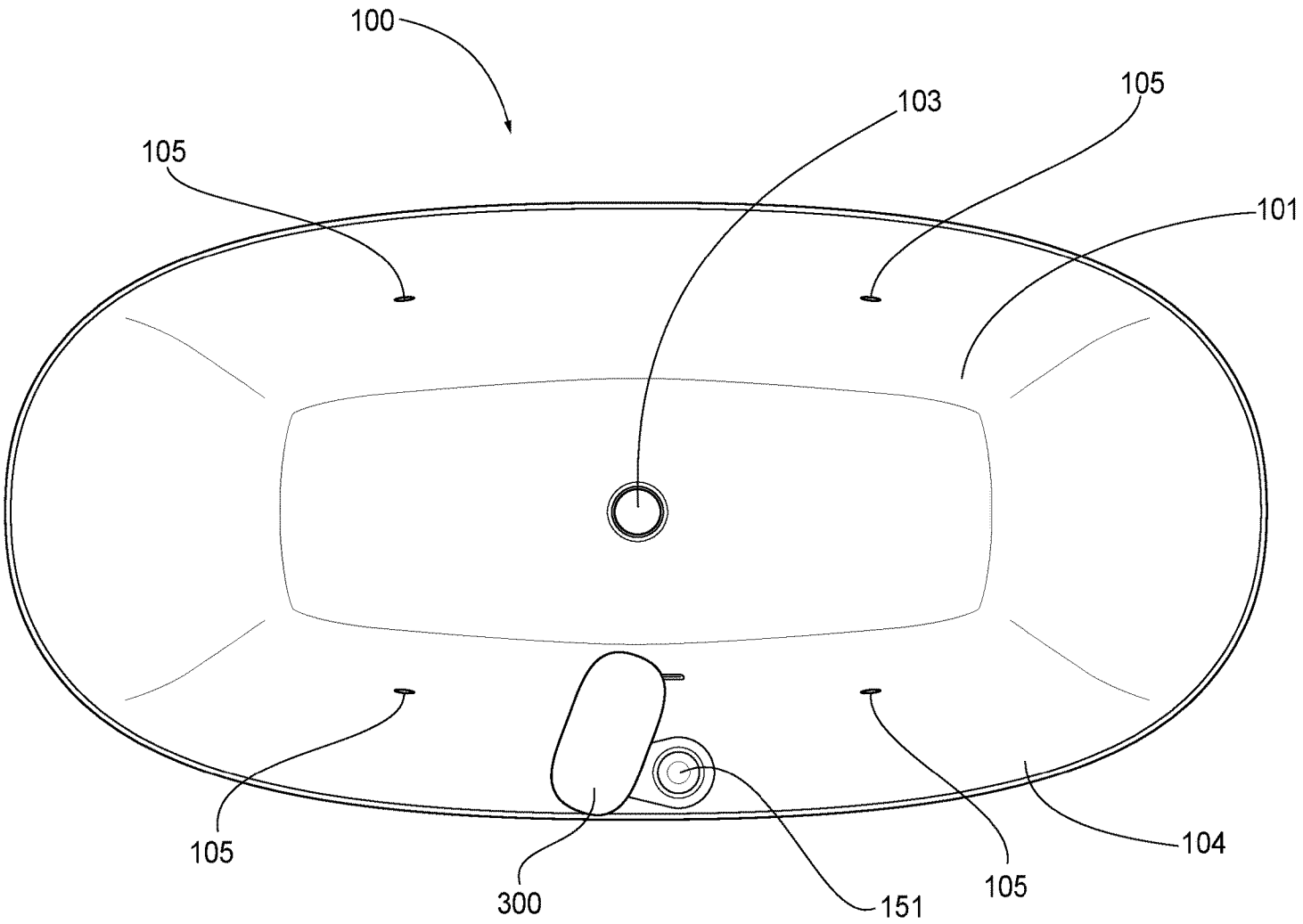
FIG. 13 is an enlarged top view of the upper rim and control panel of the bathtub assembly of FIG. 1.
Figure 14:
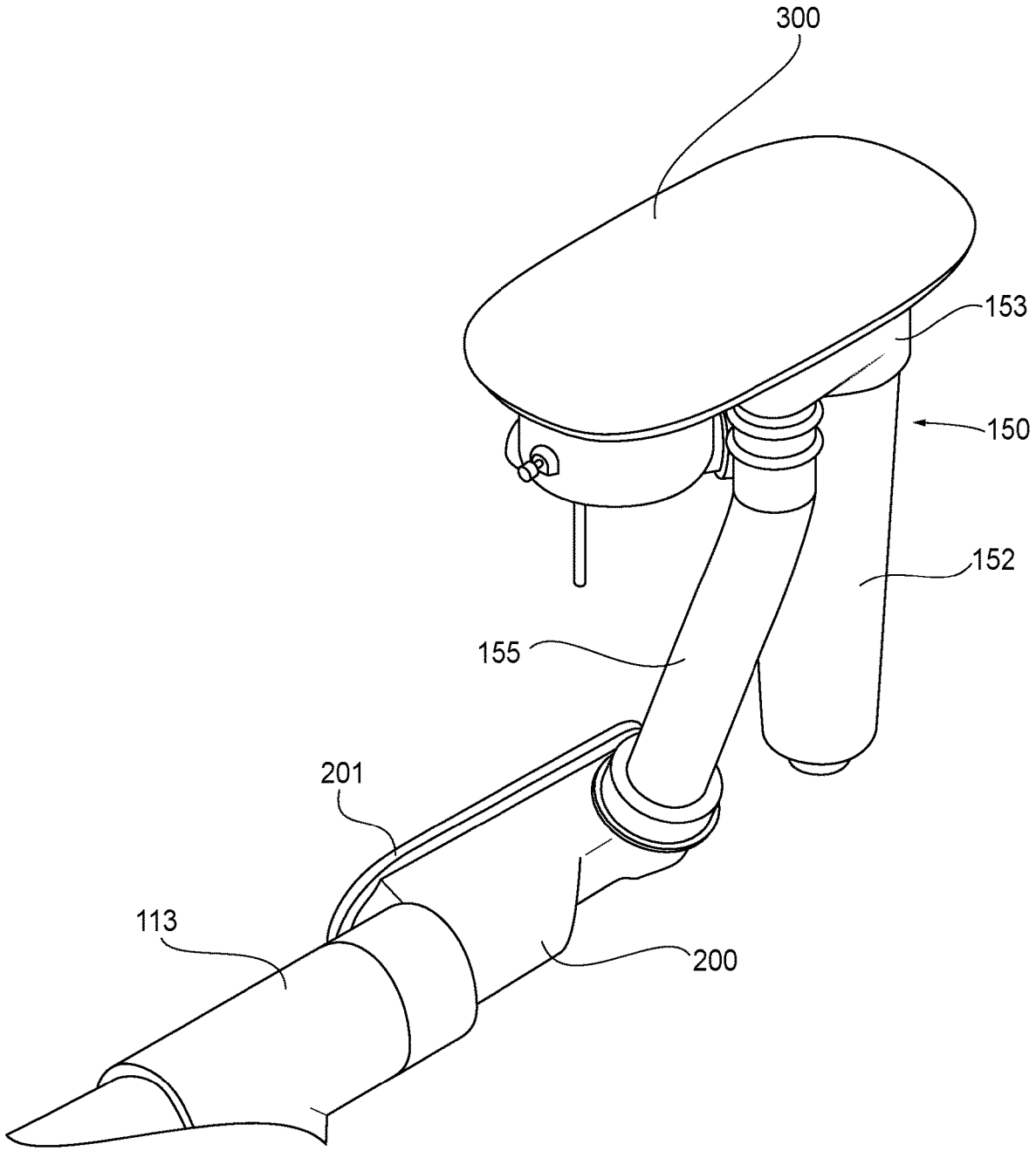
FIG. 14 is a perspective view of a dispenser and waterfall assembly of the bathtub assembly of FIG. 1.
Figure 15:
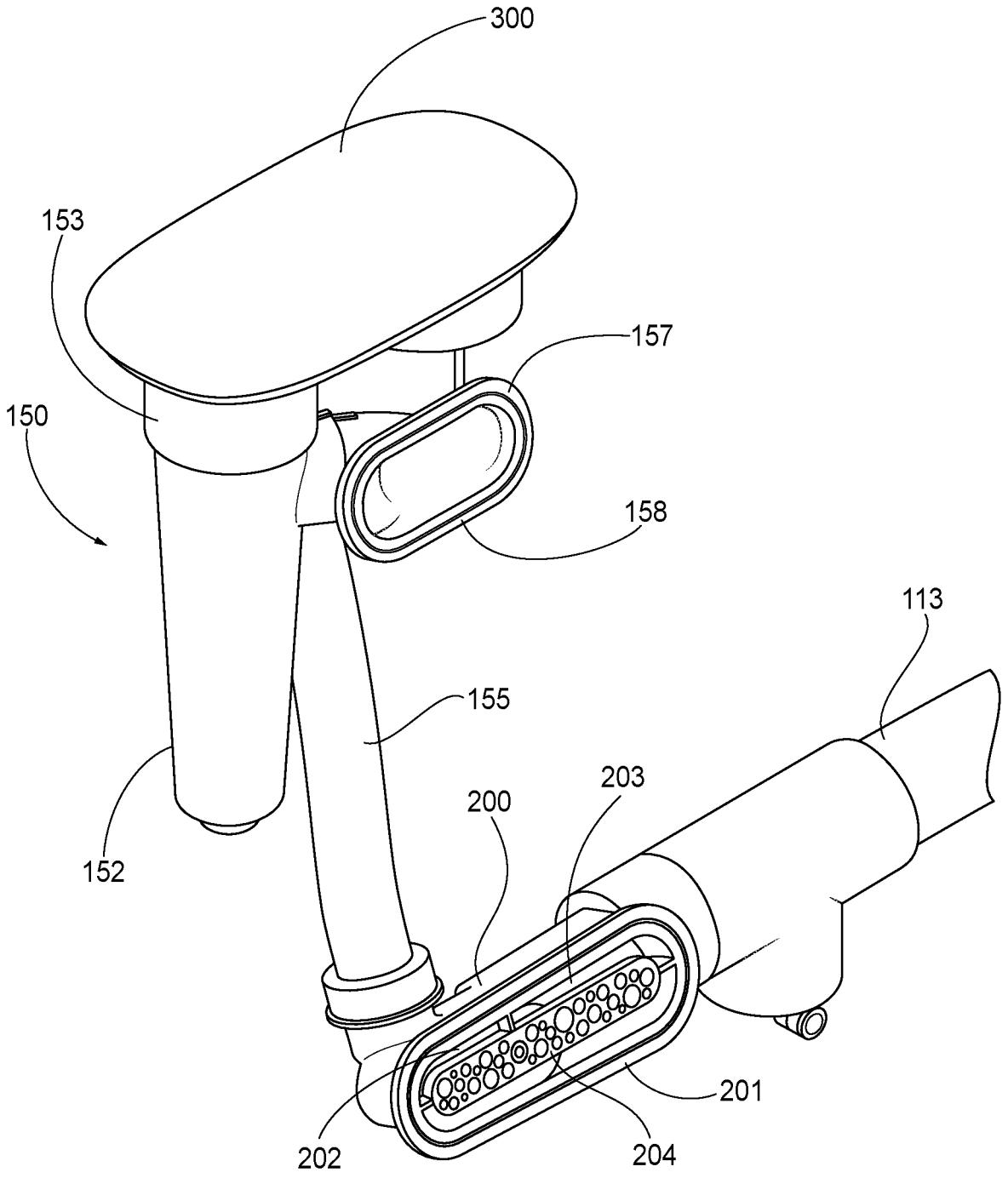
FIG. 15 is another perspective view of the dispenser and waterfall assembly of FIG. 14.
Figure 16:
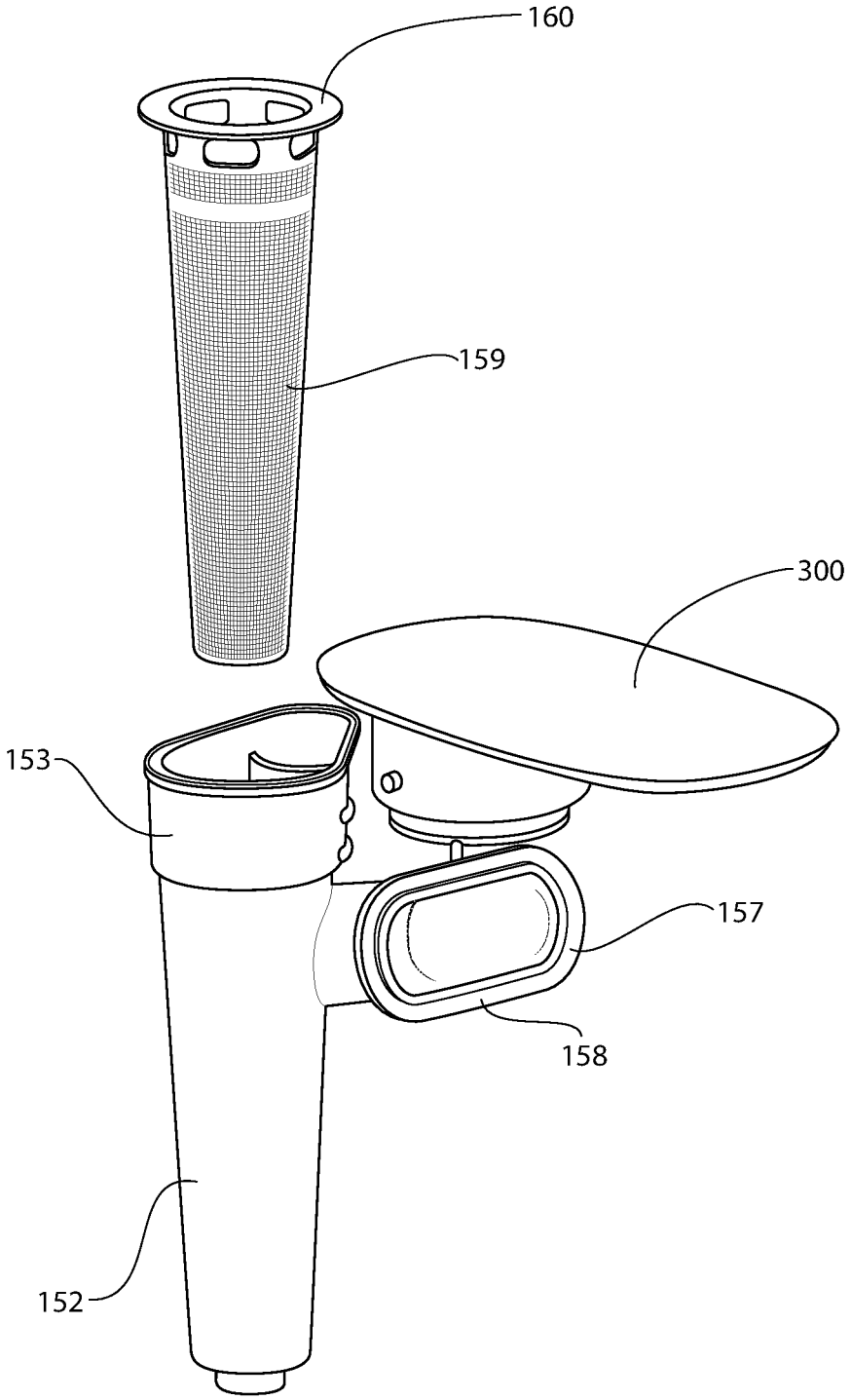
FIG. 16 is a partially exploded view of the dispenser and waterfall assembly of FIG. 14.
Figure 17:
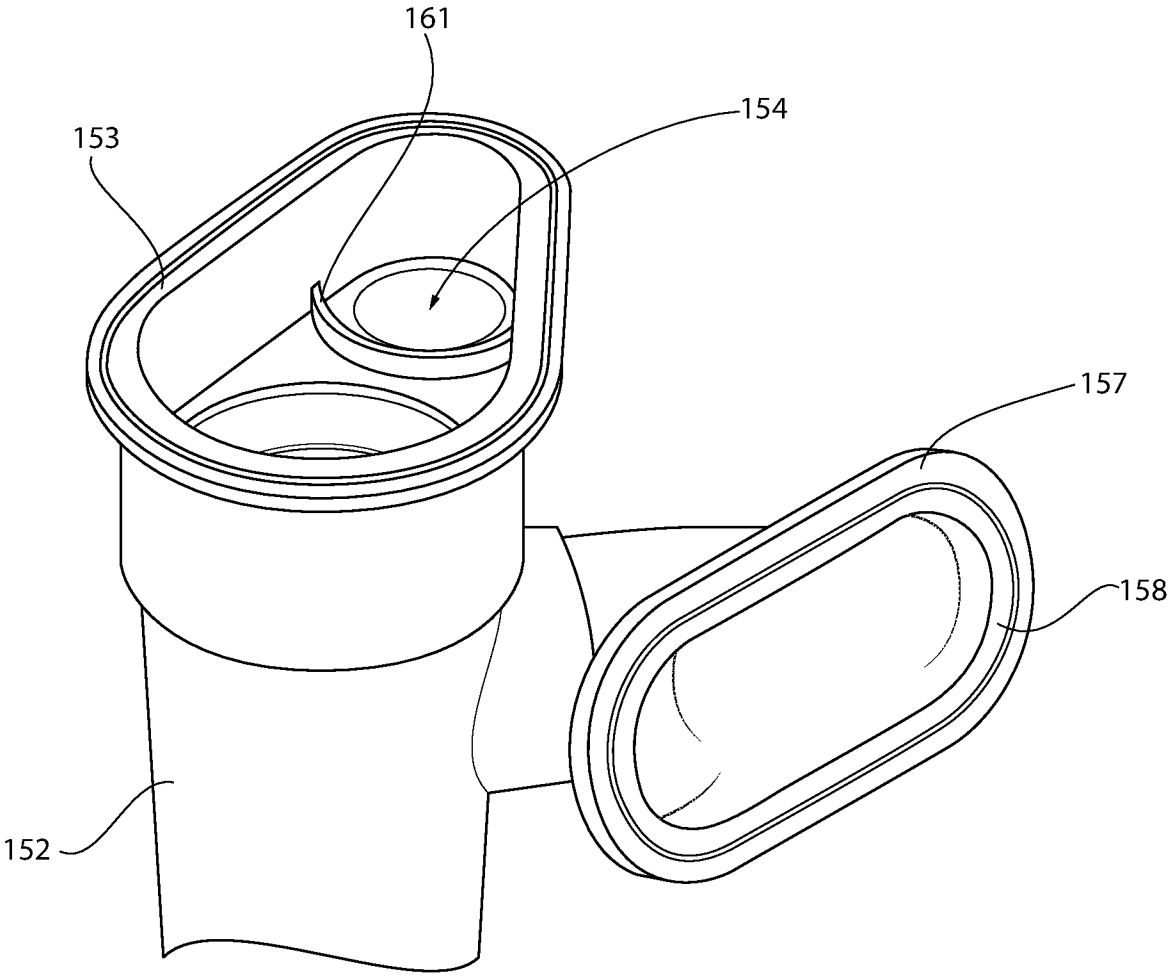
FIG. 17 is an enlarged perspective view of a waterfall plenum chamber of the dispenser and waterfall assembly of FIG. 14.
Figure 18:
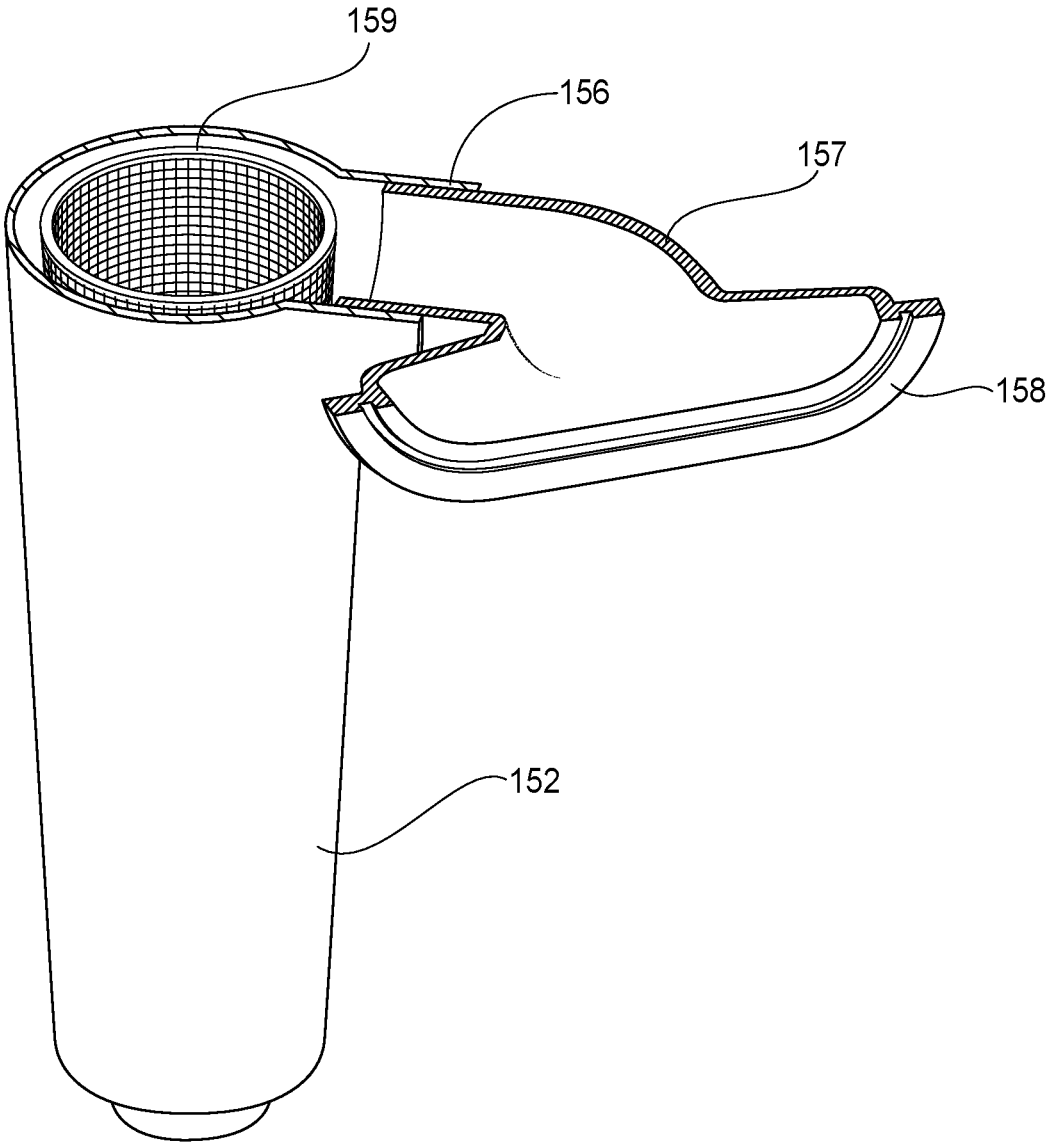
FIG. 18 is an enlarged cross-sectional perspective view of the dispenser and waterfall assembly of FIG. 14.
Figure 19:
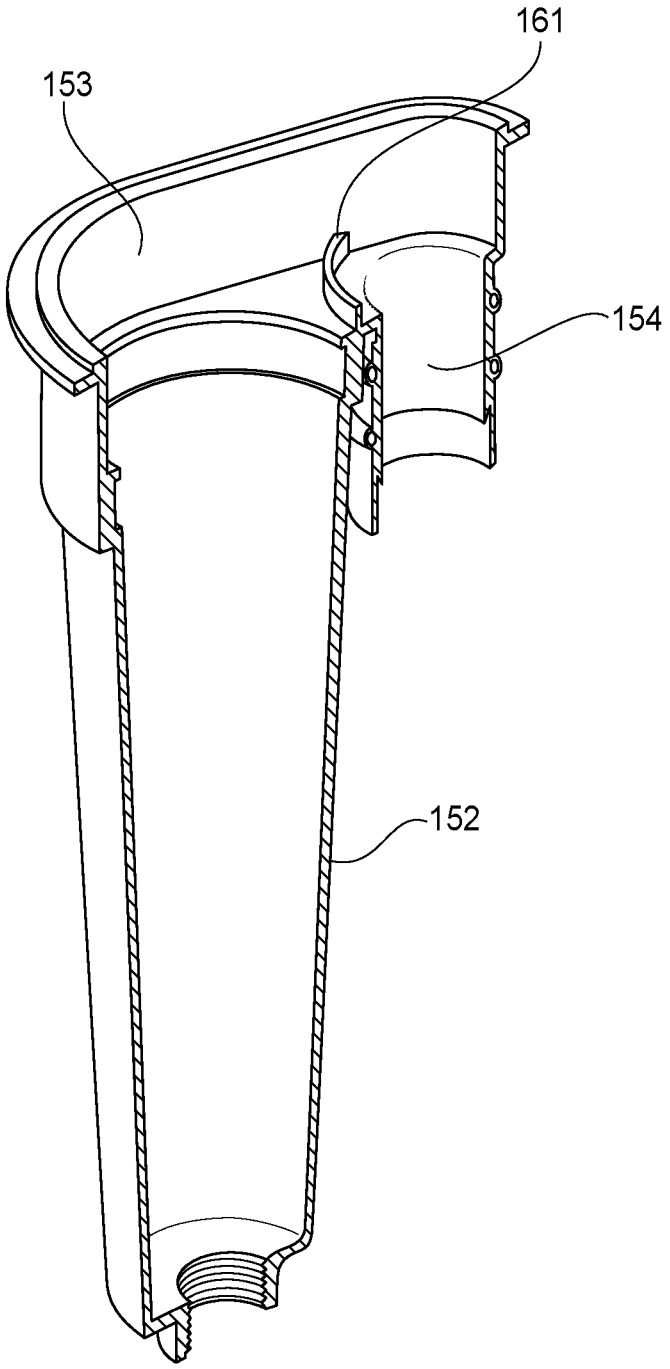
FIG. 19 is another enlarged cross-sectional perspective view of the dispenser and waterfall assembly of FIG. 14.
Figure 20:
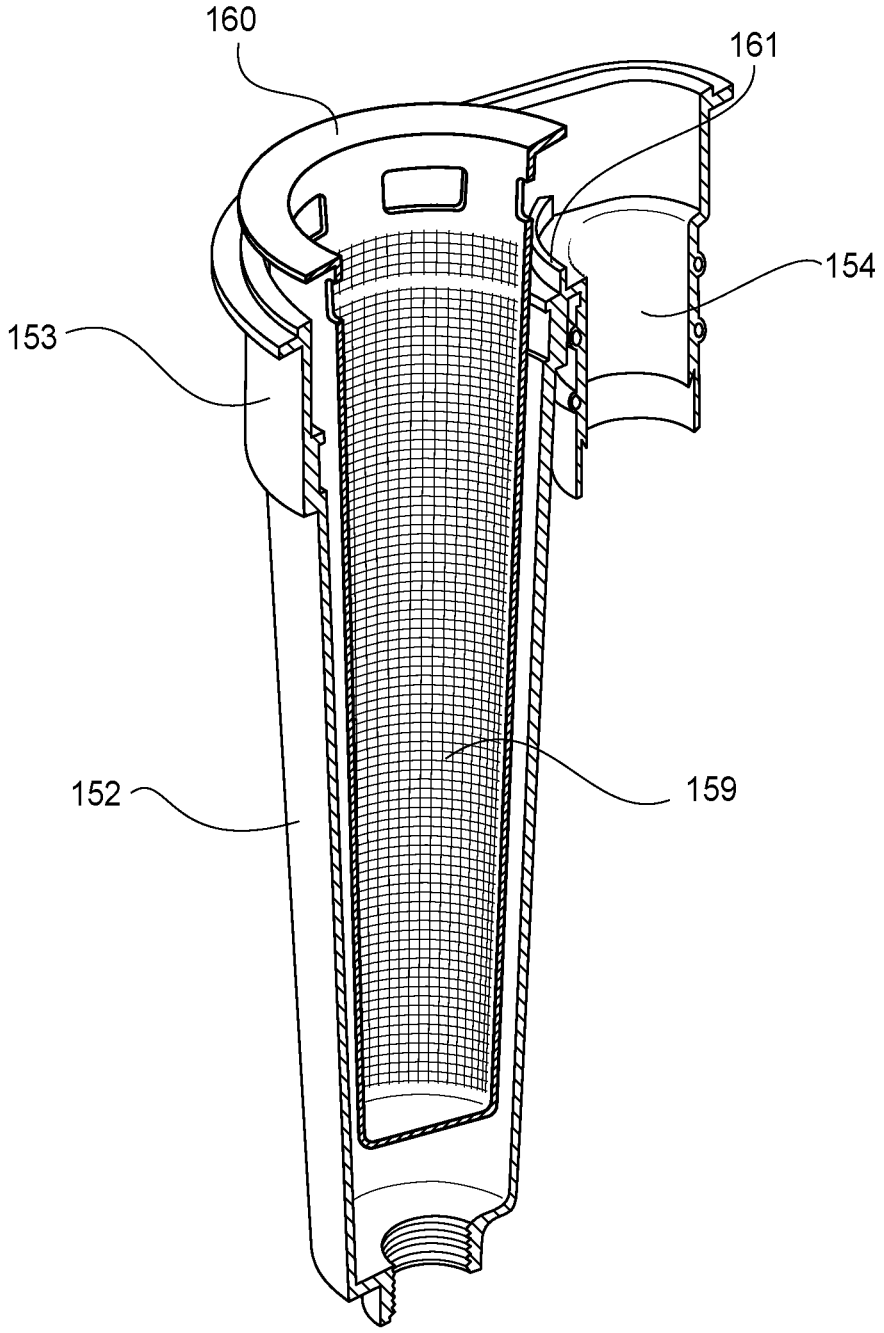
FIG. 20 is another enlarged cross-sectional perspective view of the dispenser and waterfall assembly of FIG. 14.
Figure 21:
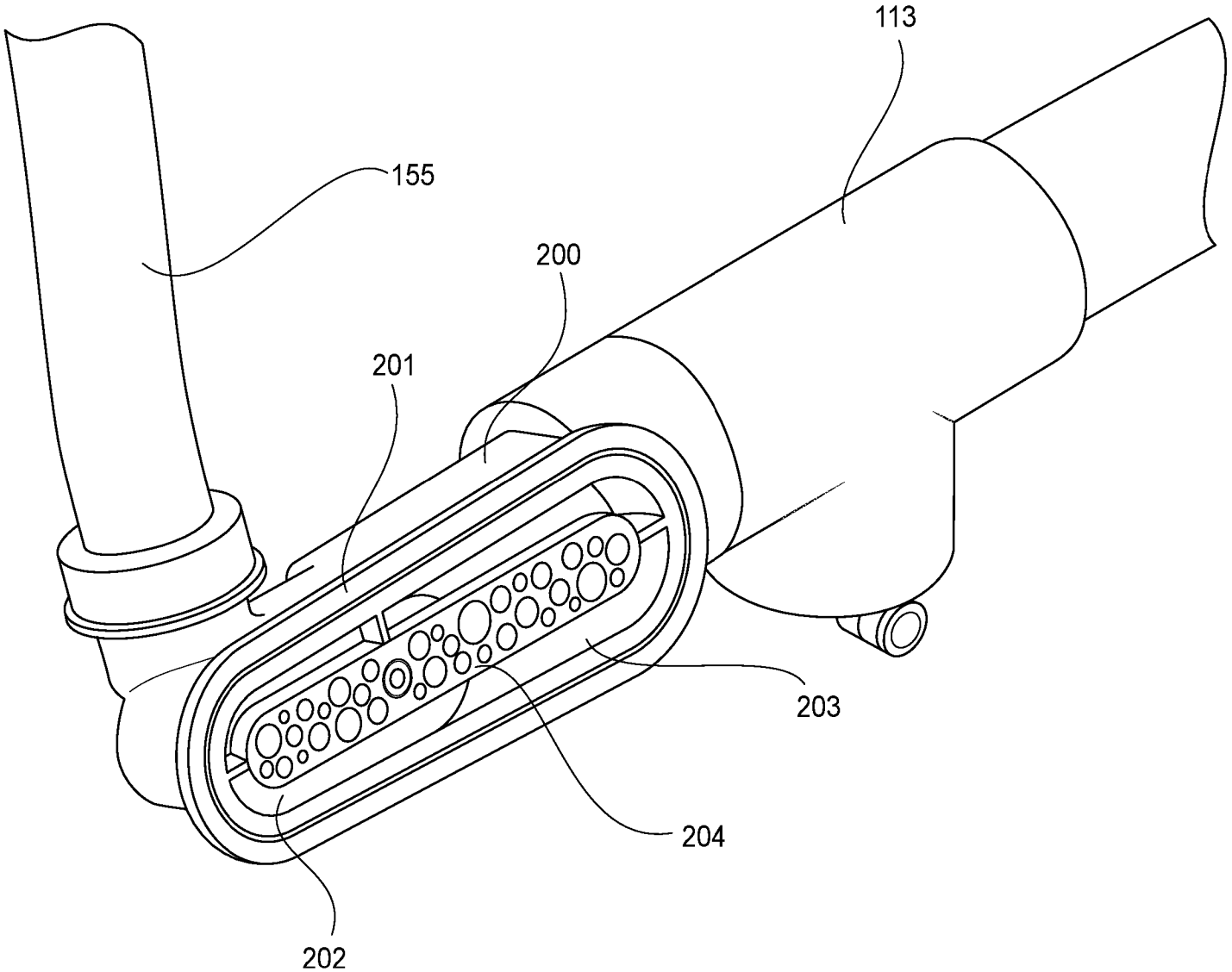
FIG. 21 is a perspective view of a suction fitting/dispenser overflow drain of the bathtub assembly of FIG. 1 connected to the liquid circulation system.
Figure 22:
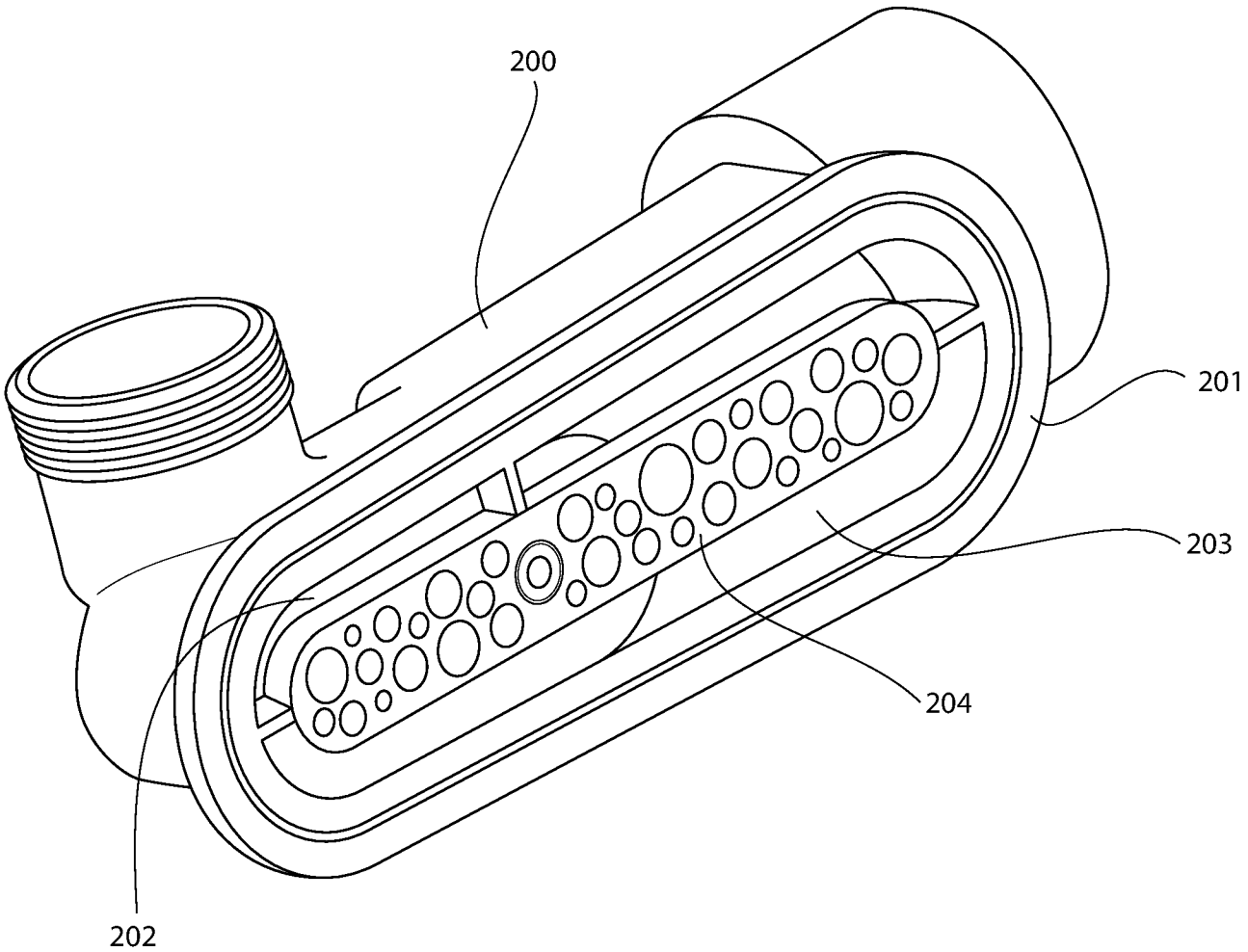
FIG. 22 is another perspective view of the suction fitting/dispenser overflow drain of FIG. 21.
Figure 23:
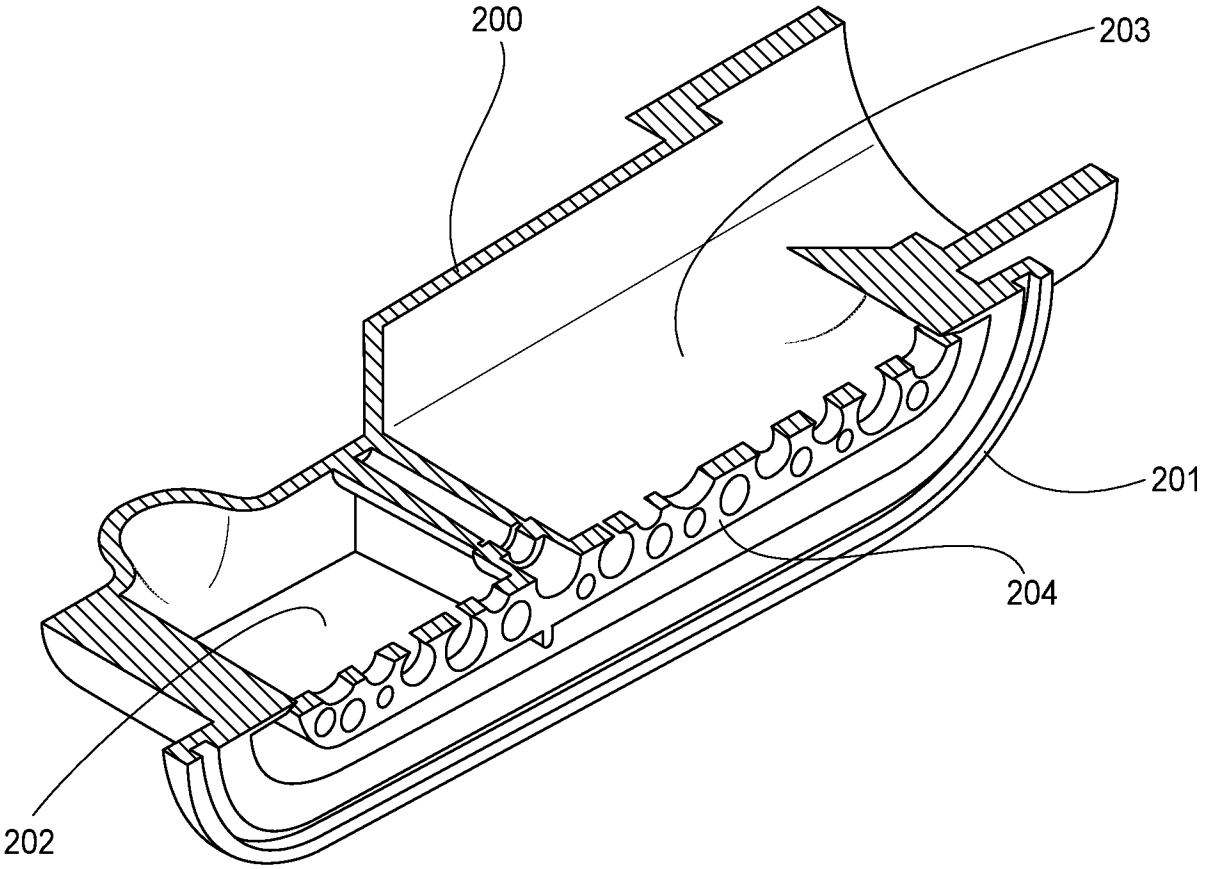
FIG. 23 is a cross-sectional perspective view of the suction fitting/dispenser overflow drain of FIG. 21.
Figure 24:
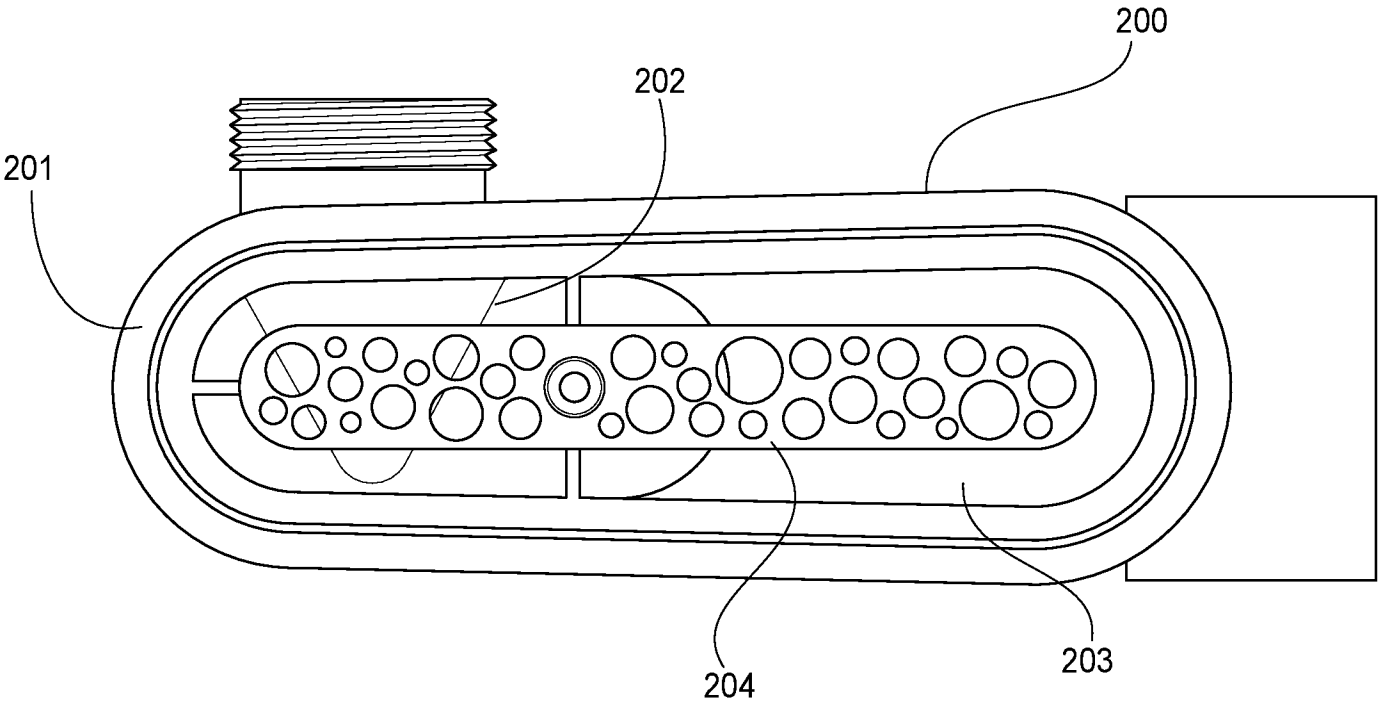
FIG. 24 is a front view of the suction fitting/dispenser overflow drain of FIG. 21.
Figure 25:
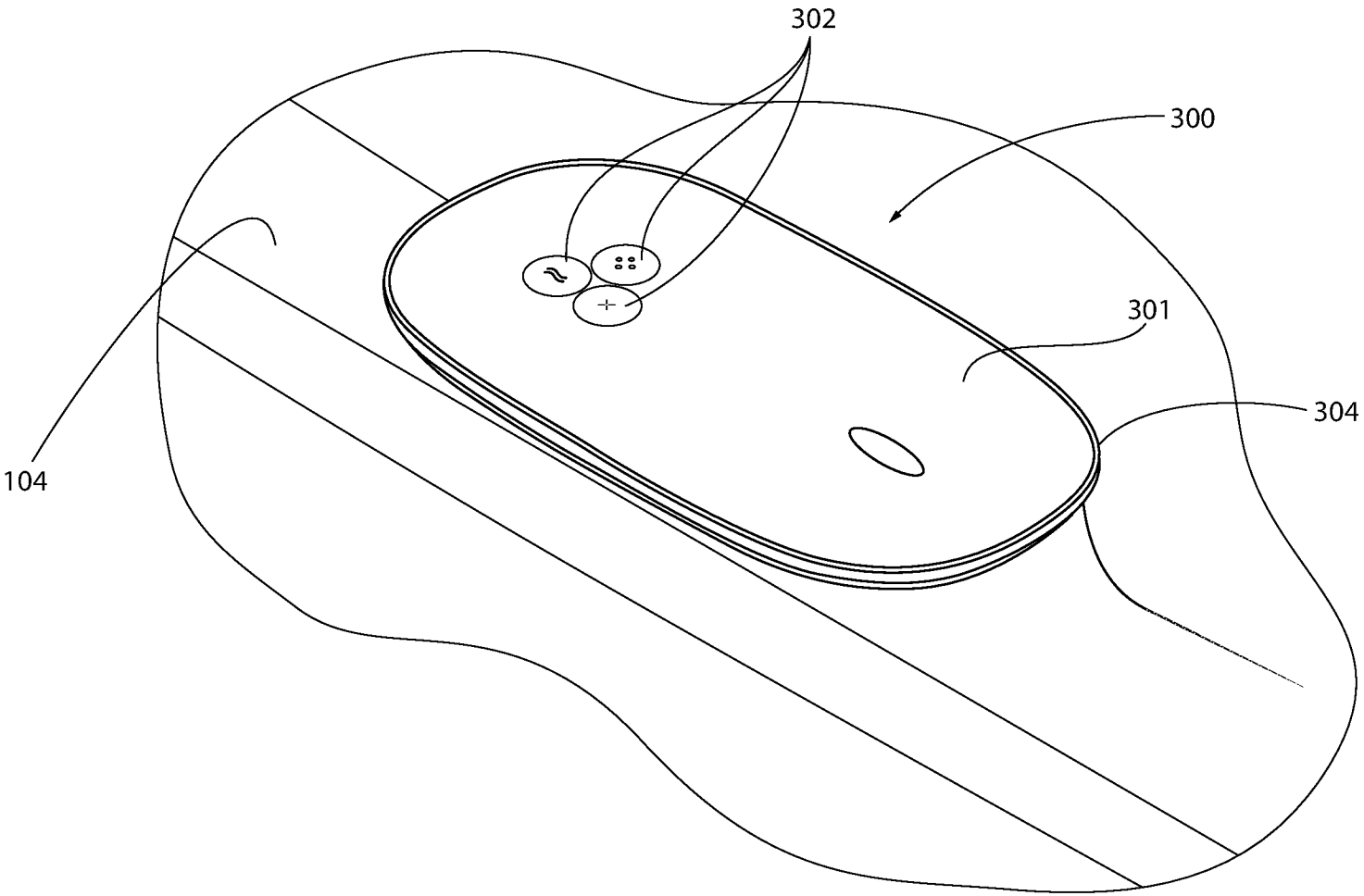
FIG. 25 is an enlarged perspective view of a control panel of the bathtub assembly of FIG. 1 installed on an upper rim of the bathtub.
Figure 29:
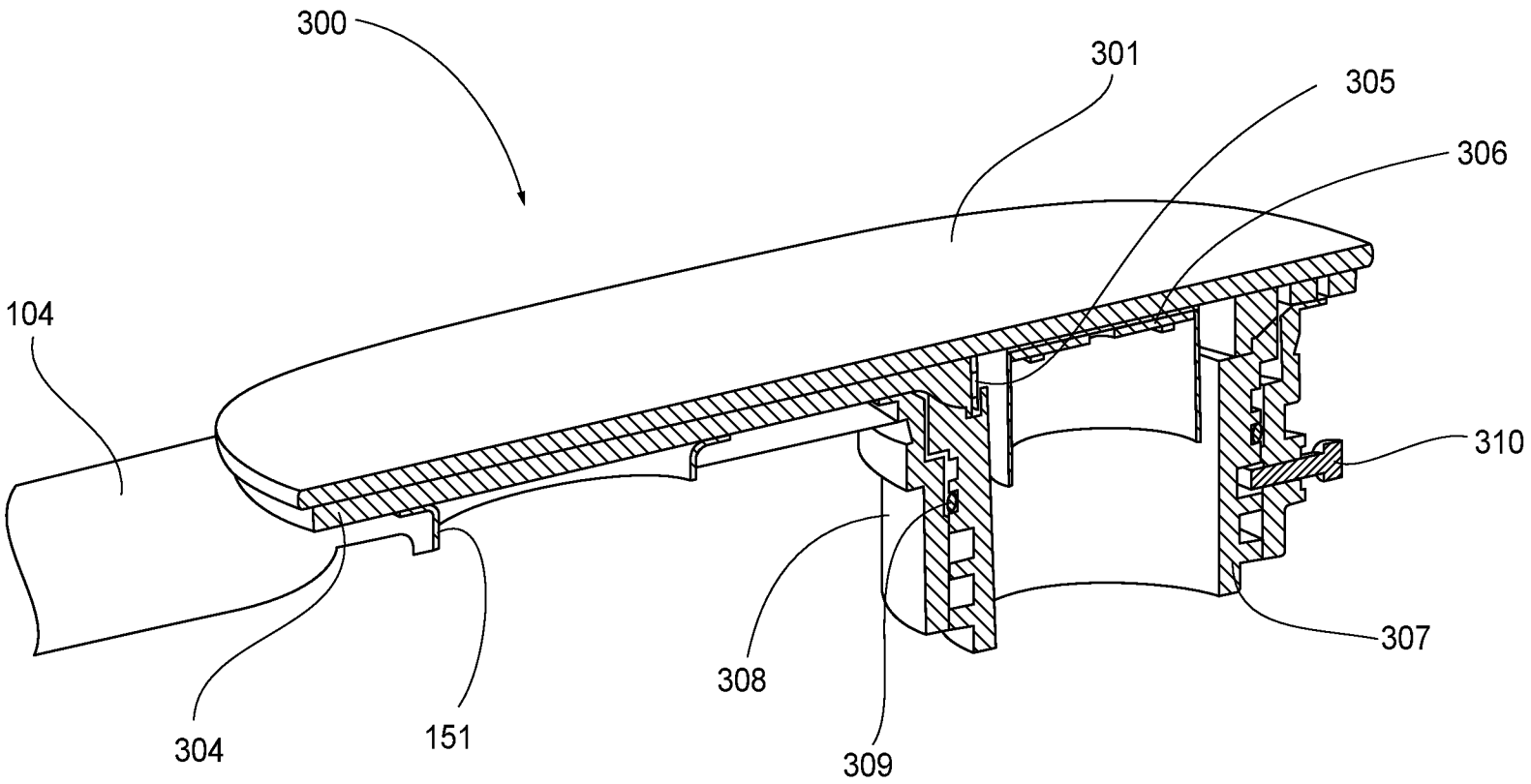
FIG. 29 is a cross-sectional perspective view of the control panel of FIG. 25.

As shown in FIGS. 13 and 29, the dispenser/waterfall assembly 150 includes a dispenser inlet 151 disposed in the upper rim 104 of the inner shell 101. The dispenser inlet 151 provides access to the dispenser tank 152 and the strainer/basket 159 for placing the substance in the strainer/basket 159. The control panel 300 is rotatably mounted on the upper rim 104 adjacent to the dispenser inlet 151 so that the control panel 300 may be rotated by the user between a position exposing the dispenser inlet 151, as shown in FIG. 13, and a position covering the dispenser inlet 151, as shown in FIG. 5, for example. This feature allows for the dispenser inlet 151 to be closed and hidden in the upper rim 104 until the user desires to access the dispenser assembly without the need for a separate cap or closure mechanism, which may become difficult to open, may be lost, and may detract from the overall aesthetic appearance of the bathtub assembly 100.

With reference to FIGS. 3, 14, 15, and 21-24, the bathtub assembly 100 also includes the suction fitting/dispenser overflow drain 200 connected to the exterior surface of the inner shell 101 at the at least one suction opening 106. The suction fitting/dispenser overflow drain 200 may include a flange 201 along one side thereof for fastening the suction fitting/dispenser overflow drain 200 to the exterior surface of the inner shell 101 by an adhesive, such as silicon glue, or other suitable fastening mechanism. The flange 201 may incorporate a channel extending around the perimeter thereof for accommodating the adhesive. The suction fitting/overflow drain 200 includes a waterfall overflow portion 202 and a suction outlet portion 203, which are separated from each other but are both in communication with the interior cavity of inner shell 101 via the at least one suction opening 106. The waterfall overflow portion 202 receives liquid from the overflow drain outlet 154 via the overflow drain pipe 155 in order to return overflow liquid from the waterfall plenum chamber 153 to the interior cavity of the inner shell 101. The suction outlet portion 203 is connected to the suction pipeline 113 in order to convey liquid from the interior cavity of the inner shell 101 back to the pump 111 and the circulation system 110. The opening into the suction fitting/dispenser overflow drain 200 may be covered with a suction cover 204 to prevent or limit the occurrence of solid objects entering into the suction fitting/dispenser overflow drain 200 and becoming caught or traveling into the circulation system 110.

With reference to FIGS. 3 and 12-24, the dispenser/waterfall assembly 150 can be accessed by rotating the control panel 300 to an opening position revealing the dispenser inlet 151. The substance or substances are loaded into the strainer/basket 159 positioned within the dispenser tank 152. With the pump 111 in operation, the user may activate a touchscreen control 302 on the control panel 300 to operate the electronic valve 115 to open the dispenser pipeline 114 to flow through the circulation system 110. Liquid then flows into the dispenser tank 152 from the bottom and upward through the strainer/basket 159 to dissolve or entrain the substance(s) in the strainer/basket 159. The liquid then passes through the at least one directed flow opening/waterfall opening 107 via the outlet housing 157 in the form of the waterfall W. The hydrostatic pressure for forming the waterfall W is created by the reservoir of liquid held within the top of the dispenser tank 152 and the waterfall plenum chamber 153. If, during activation of the dispensing functions, the user obstructs the outlet housing 157 or the directed flow jets 120, causing the level of the liquid to rise abnormally within the dispenser tank 152 and the waterfall plenum chamber 153, the liquid will fall over the divider wall 161 in the waterfall plenum chamber 153 and into the overflow drain outlet 154 such that the overflow liquid is returned to the interior cavity of the inner shell 101 through the overflow drain pipe 155 and the suction fitting/dispenser overflow drain 200.

According to an example of the present disclosure, the dispenser/waterfall assembly 150 is configured to receive any dissolvable or entrainable substance found to be suitable by those having ordinary skill in the art for use in connection with the bathtub assembly 100. A dissolvable substance is a substance that, when exposed to the liquid flowing through the dispenser/waterfall assembly 150, will dissolve in the liquid flow and be carried into the interior cavity of the inner shell 101 by the flow of liquid passing through outlet housing 157 and the at least one dispenser flow opening 107. An entrainable substance is a substance that, when exposed to the liquid flowing through the dispenser/waterfall assembly 150, will mix and/or blend with and thereby become entrained in the liquid flow and be carried into the interior cavity of the inner shell 101 by the flow of liquid passing through the outlet housing 157 and the at least one dispenser flow opening 107. Examples of such dissolvable and/or entrainable substances include bath salts, herbs, aromatherapy, essential oils, plant and flower extracts, cleaning agents, or combinations of such substances. The substances may be provided and loaded into the dispenser tank 152 in the form of powders, granular powders or crystals, liquids, tablets, soluble capsules or pods, etc. According to an example of the present disclosure, the substance may be provided in a sealed, pre-measured, disposable pod, cup, or container, and the dispenser tank 152 and/or the strainer/basket 159 may be provided with a piercing or cutting mechanism configured to couple with the disposable pod, cup, or container and pierce or cut the sealed disposable pod, cup, or container and thereby expose the substance within the sealed disposable pod, cup, or container to the flow of liquid through the dispenser/waterfall assembly 150.

It is to be appreciated that the substances may introduced into the interior cavity of the inner shell 101 of the bathtub assembly 100 in a variety of manners different from the waterfall W discussed above. For instance, the at least one dispenser flow opening 107 may be disposed in the inner shell 101 below the max bath level such that a waterfall W is not formed by the liquid flow through the dispenser assembly and the outlet housing. According to one example of the present disclosure, the dispenser assembly is in communication with one or more directed flow jets, such as the directed flow jets 120 discussed above or similar directed flow jets, such that the directed flow jets also act as the outlet housings for the dispenser assembly and the substance placed in the dispenser assembly is introduced into the volume of liquid in the interior cavity of the inner shell 101 via the directed flow.

IV. Control Panel

With reference to FIGS. 25-29, the bathtub assembly 100 includes the control panel 300 rotatably mounted on the upper rim 104 of the inner shell 101. The control panel 300 includes a touchscreen interface 301 defining a number of touchscreen controls 302. As discussed above, according to an example of the present disclosure, the touchscreen controls 302 may include a control for activating the pump 111 to create the directed flow through the directed flow jets 120 and for controlling the pump 111 to adjust the intensity/speed of the directed flow, a control for operating the valve 115 to open flow through the dispenser/waterfall assembly 150 in order to form the waterfall W and dispense the substances into the volume of the liquid in the interior cavity of the inner shell 101, and a control for activating the lighting features and adjusting the intensity/brightness of the light emitted by the lighting features. According to the illustrated example, the touchscreen interface 301 includes three touchscreen controls 302 in the form of touchscreen buttons. It is to be appreciated that more or fewer touchscreen controls 302 may be provided and in any configuration or type as found to be suitable to those having ordinary skill in the art.

Figure 26:
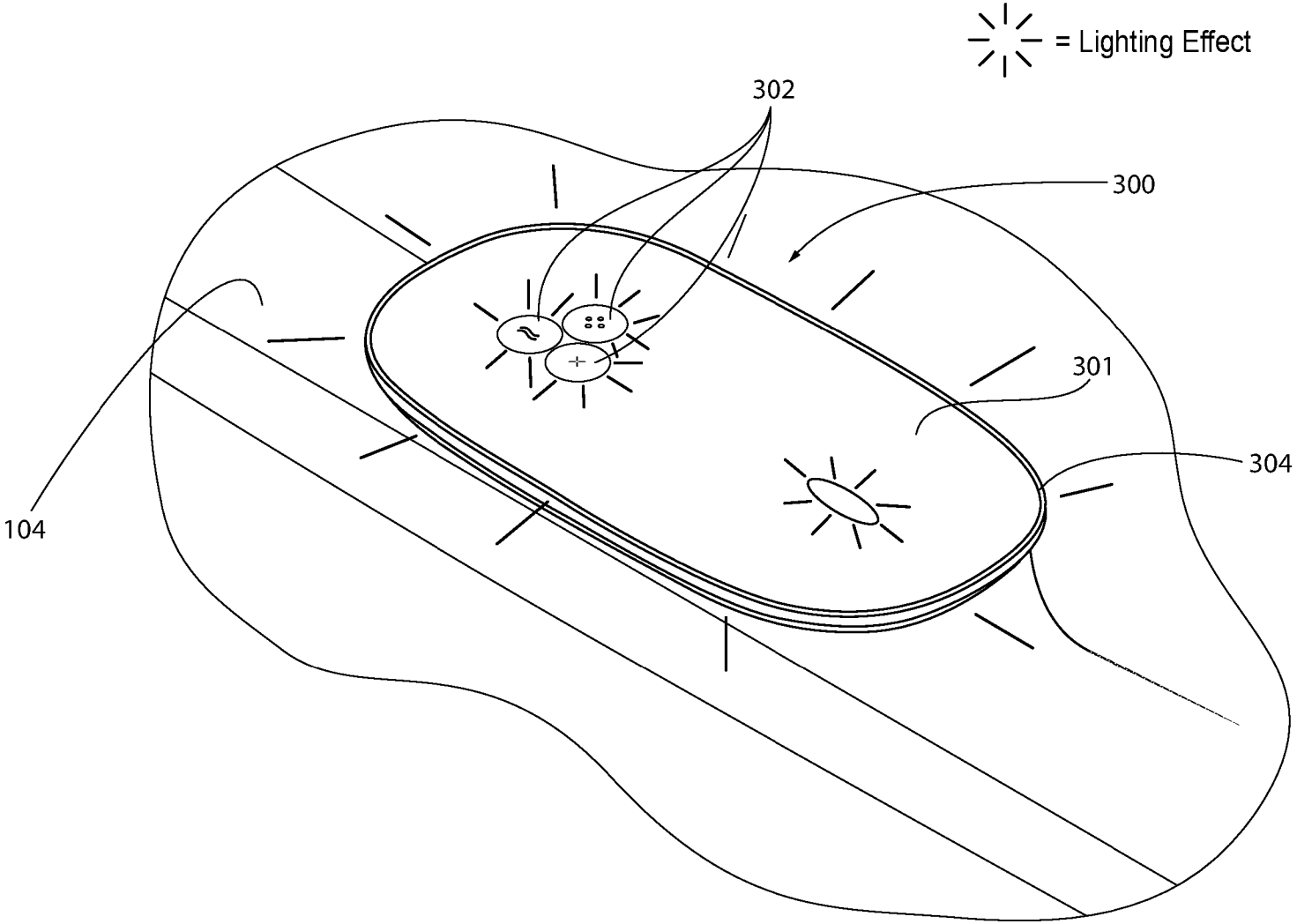
FIG. 26 is a perspective view of the control panel of FIG. 25 with the lighting features activated.

The control panel 300 also includes a light guide/diffuser 304 positioned below the touchscreen interface 301. The light guide/diffuser 304 transmits light from an LED strip 305, shown in FIG. 29, positioned within the control panel 300 to the perimeter of the control panel 300, as shown in FIGS. 7 and 26, in order to create a mood-lighting effect similar to the lighting provided by the RGB LEDs 125 provided on the directed flow jets 120. According to an example of the present disclosure, the LED strip 305 and the RGB LEDs 125 are operated by the control panel 300 to transmit light at a uniform or nearly uniform color and intensity.

Figure 27:
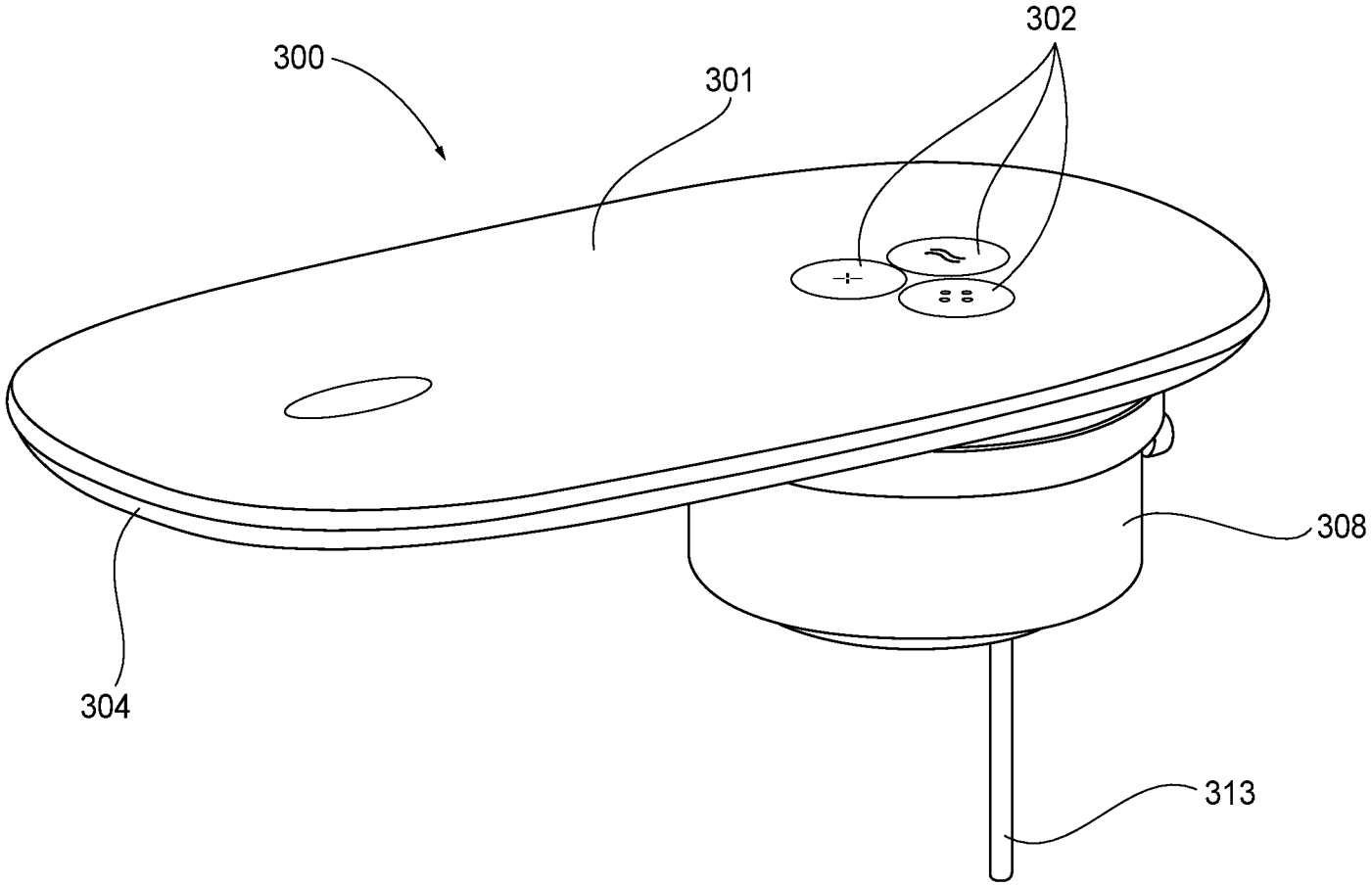
FIG. 27 is a perspective view of an extractable unit of the control panel of FIG. 25.
Figure 28:
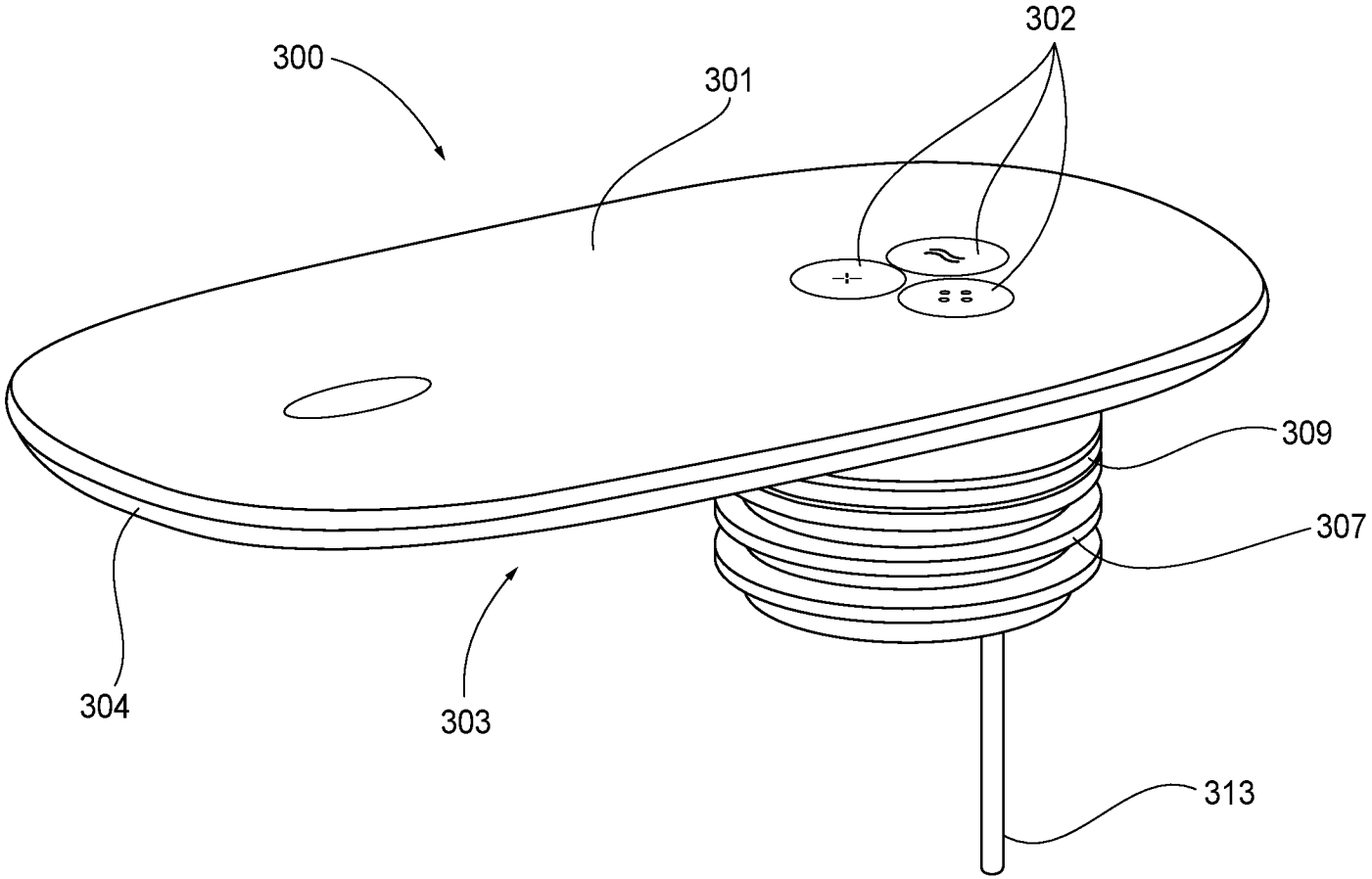
FIG. 28 is another perspective view of the extractable unit of FIG. 27 with external components removed.

As shown in FIGS. 27-29, the control panel 300 is provided as an extractable unit 303 assembled on the upper rim 104 of the inner shell 101. The extractable unit 303 is configured to be removable from the inner shell 101 to allow for repair and replacement of the extractable unit 303 in the event of damage to the control panel 300 and/or upgrading of the control panel 300 or its components/software. The extractable unit 303 includes the touchscreen interface 301, light guide/diffuser 304, and a housing 307. The housing 307 contains the touchscreen electronics 306, including the controller depending from the touchscreen interface 301 through an opening in the light guide/diffuser 304 and the strip LED 305, which is formed in a circular or arc-shaped structure and positioned to surround or at least partially surround the touchscreen electronics 306 within the opening in the light guide/diffuser 304. The touchscreen electronics 306 are configured to control the operations of the components of the bathtub assembly 100, including the pump 111, the electronic valve 115, and the lighting features 125, 305. Wiring 313 is connected to the touchscreen electronics 306 within the housing 307 and connects the touchscreen electronics 306 with the controlled components of the bathtub assembly 100. According to one example of the present disclosure, the touchscreen electronics 306 are configured to be waterproof or water resistant and are capable of operating when exposed to water or other liquids. According to another example of the present disclosure, the housing 307 includes a bottom member that seals the interior of the housing 307 and provides a volume for protecting the touchscreen electronics 306 from moisture and contaminants.

A rotation mechanism 308 is provided in an opening defined in the upper rim 104 of the inner shell 101 that engages the housing 307 to rotatably support the extractable unit 303 on the upper rim 104 and allow the control panel 300 to be rotated by the user between the positions exposing and covering the dispenser inlet 151. An O-ring or gasket 309 is provided around the housing 307 for sealing the engagement between the housing 307 and the rotation mechanism 308. A lock pin 310 is inserted through an aperture defined in the rotation mechanism to engage a groove or channel defined in the housing 307. The lock pin 310 engages the housing 307 and the rotation mechanism 308 to prevent the extractable unit 303 from being removed directly from the upper rim 104. To remove the extractable unit 303, a technician must first access the interior space between the inner shell 101 and the outer shell 102 and remove the lock pin 310 from the engagement with the housing 307 and the rotation mechanism 308. According to an example of the present disclosure, the housing 307 and/or the rotation mechanism 308 may include rotation stops for limiting rotation of the control panel 300 beyond the positions covering and exposing the dispenser inlet 151.

With reference to FIGS. 1-29, according to an example of the present disclosure, a method of operating a bathtub assembly 100 is provided. The method includes providing the bathtub assembly 100. The bathtub assembly 100 includes a bathtub shell 101 defining an interior cavity configured to contain a volume of liquid, the bathtub shell 101 having at least one dispenser flow opening 107 and a plurality of directed flow openings 105 defined therein; a circulation system 110 in communication with the interior cavity of the bathtub shell 101, the circulation system 110 being configured to create a flow of the liquid to and from the interior cavity of the bathtub shell 101; a plurality of directed flow jets 120 in fluid communication between the circulation system 110 and the interior cavity of the bathtub shell 101, the plurality of directed flow jets 120 being configured to convey at least a first portion of the flow of the liquid through the directed flow openings 105 to create a directed flow of the liquid within the interior cavity of the bathtub shell 101; a housing 157 in fluid communication between the circulation system 110 and the interior cavity of the bathtub shell 101, the housing 157 being connected to the bathtub shell 101 at the at least one dispenser flow opening 107 and configured to convey a second portion of the flow of the liquid created by the circulation system 110 into the interior cavity of the bathtub shell 101 through the at least one dispenser flow opening 107; a dispenser assembly in fluid communication between the circulation system 110 and the housing 157, the dispenser assembly being configured to contain a substance therein and to expose the substance to the second portion of the flow of the liquid conveyed to the at least one dispenser flow opening 107 such that the substance is introduced into the volume of liquid in the interior cavity of the bathtub shell 101 via the at least one dispenser flow opening 107; and a valve 115 positioned in the circulation system 110, the valve 115 being configured to be operated to allow the second portion of the flow of the liquid created by the circulation system 110 to be directed to the dispenser assembly and the housing 157. The method further includes filling the interior cavity of the bathtub shell 101 with the volume of liquid; inserting the substance into the dispenser assembly; activating the circulation system 110 to create the flow of the liquid to and from the interior cavity of the bathtub shell 101 through the directed flow jets to form the directed flow of the liquid within the interior cavity of the bathtub shell; and operating the valve 115 to allow the second portion of the flow of the liquid to pass through the dispenser assembly, the housing 157, and the at least one dispenser flow opening 107 to introduce the substance to the volume of liquid in the interior cavity of the bathtub shell 101 via the at least one dispenser flow opening 107.

The bathtub assembly 100 may further include a control panel 300 configured to be operated to control the circulation system 110 and the valve 115. The step of activating the circulation system 110 may include actuating a first control 302 on the control panel 300 for controlling the circulation system 110 to create the flow of the liquid to and from the interior cavity, and the step of operating the valve 115 may include actuating a second control 302 on the control panel 300 for controlling the valve 115 to allow the second portion of the flow of the liquid to be directed to the dispenser assembly and the housing 157.

The control panel 300 may be rotatably connected to an upper rim 104 of the bathtub shell 101. The dispenser assembly may include a dispenser inlet 151 disposed in the upper rim 104 of the bathtub shell 101 adjacent to the control panel 300 and configured to provide access for placing the substance in the dispenser assembly; and the step of inserting the substance into the dispenser assembly may include rotating the control panel 300 to a position exposing the dispenser inlet 151, inserting the substances into the dispenser assembly via the dispenser inlet 151, and rotating the control panel 300 to a position covering the dispenser inlet 151.

The bathtub assembly 100 may further include a plurality of lighting features 125, 305, and the control panel 300 is configured to be operated to control the lighting features 125, 305. The method may further include actuating a third control 302 on the control panel 300 for controlling the lighting features 125, 305 to operate the lighting features 125, 305 and to adjust a color and intensity of light emitted by the lighting features 125, 305.

The at least one dispenser flow opening 107 may include a waterfall opening 107, and the bathtub assembly 100 may further include a waterfall plenum chamber 153 in fluid communication with the dispenser assembly and the housing 157. The dispenser assembly, the waterfall plenum chamber 153, the housing 157, and the waterfall opening 107 are configured to form the second portion of the flow of the liquid into a waterfall W as the second portion of the flow of the liquid passes through the waterfall opening 107 into the interior cavity of the bathtub shell 101.

It is to be understood that the invention may assume various alternative variations and step sequences, except where expressly specified to the contrary. It is also to be understood that the specific devices and processes illustrated in the attached drawings, and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that to the extent possible, one or more features of any embodiment or aspect can be combined with one or more features of any other embodiment or aspect.

The invention claimed is:

1. A bathtub assembly comprising:

a bathtub shell defining an interior cavity configured to contain a volume of liquid, the bathtub shell comprising an upper rim at least partially surrounding the interior cavity and having at least one dispenser flow opening defined therein;

a circulation system in communication with the interior cavity of the bathtub shell, the circulation system being configured to create a flow of the liquid to and from the interior cavity of the bathtub shell;

a housing in fluid communication between the circulation system and the interior cavity of the bathtub shell, the housing being connected to the bathtub shell at the at least one dispenser flow opening and configured to convey at least a portion of the flow of the liquid created by the circulation system into the interior cavity of the bathtub shell through the at least one dispenser flow opening;

a dispenser assembly in fluid communication between the circulation system and the housing, the dispenser assembly being configured to contain a substance therein and to expose the substance to the at least a portion of the flow of the liquid conveyed to the at least one dispenser flow opening such that the substance is introduced into the volume of liquid in the interior cavity of the bathtub shell via the at least one dispenser flow opening and the dispenser assembly comprising a dispenser inlet disposed in the upper rim of the bathtub shell configured to provide access for placing the substance in the dispenser assembly; and a control panel configured to be operated to control the circulation system, the control panel being disposed on the upper rim of the bathtub shell adjacent to the dispenser inlet, the control panel being rotatably connected to the upper rim between a position exposing the dispenser inlet and a position covering the dispenser inlet.

2. The bathtub assembly according to claim 1, wherein the at least one dispenser flow opening comprises a waterfall opening and the bathtub assembly further comprises a waterfall plenum chamber in fluid communication with the dispenser assembly and the housing, and wherein the dispenser assembly, waterfall plenum chamber, the housing, and the waterfall opening are configured to form the at least a portion of the flow of the liquid into a waterfall as the at least a portion of the flow of the liquid passes through the waterfall opening into the interior cavity of the bathtub shell.

3. The bathtub assembly according to claim 1, wherein the bathtub shell has a plurality of directed flow openings defined therein, and wherein the bathtub assembly further comprises a plurality of directed flow jets in fluid communication between the circulation system and the interior cavity of the bathtub shell, the plurality of directed flow jets being configured to convey at least another portion of the flow of the liquid created by the circulation system into the interior cavity of the bathtub shell through the plurality of directed flow openings to create a directed flow of the liquid within the interior cavity of the bathtub shell, each of the plurality of directed flow jets comprising a flange directly affixed to an exterior surface bathtub shell at least one of the plurality of directed flow openings in the bathtub shell.

4. The bathtub assembly according to claim 1, further comprising a valve positioned in the circulation system, the valve being configured to be operated to allow the at least a portion of the flow of the liquid created by the circulation system to be directed to the dispenser assembly and the housing.

5. The bathtub assembly according to claim 1, further comprising a plurality of light features, the control panel being configured to operate the lighting features.

6. A bathtub assembly, comprising:

a bathtub shell defining an interior cavity configured to contain a volume of liquid, the bathtub shell having at least one dispenser flow opening and a plurality of directed flow openings defined therein;

a circulation system in communication with the interior cavity of the bathtub shell, the circulation system being configured to create a flow of the liquid to and from the interior cavity of the bathtub shell;

a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell;

a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening;

a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing.

7. The bathtub assembly according to claim 6, wherein the at least one dispenser flow opening comprises a waterfall opening and the bathtub assembly further comprises a waterfall plenum chamber in fluid communication with the dispenser assembly and the housing, and wherein the dispenser assembly, the waterfall plenum chamber, the housing, and the waterfall opening are configured to form the second portion of the flow of the liquid into a waterfall as the second portion of the flow of the liquid passes through the waterfall opening into the interior cavity of the bathtub shell.

8. The bathtub assembly according to claim 6, further comprising a control panel configured to be operated to control the circulation system and the valve, the control panel being rotatably connected to an upper rim of the bathtub shell, wherein the dispenser assembly comprises a dispenser inlet disposed in the upper rim of the bathtub shell adjacent to the control panel and configured to provide access for placing the substance in the dispenser assembly, and wherein the control panel is rotatable on the upper rim between a position exposing the dispenser inlet and a position covering the dispenser inlet.

9. The bathtub assembly according to claim 8, further comprising a plurality of lighting features, wherein the control panel is configured to be operated to activate the lighting features and to adjust a color and intensity of light emitted by the lighting features.

10. The bathtub assembly according to claim 9, wherein the lighting features comprise a plurality of light-emitting diodes disposed on the plurality of directed flow jets and at least one light-emitting diode disposed on the control panel.

11. The bathtub assembly according to claim 8, wherein the control panel is provided as an extractable unit removably assembled on the bathtub shell.

12. The bathtub assembly according to claim 6, wherein each of the plurality of directed flow jets comprises a flange directly affixed to an exterior surface bathtub shell at least one of the plurality of directed flow openings in the bathtub shell.

13. The bathtub assembly according to claim 12, wherein each of the plurality of directed flow jets further comprises an outlet disposed in a respective one of the plurality of directed flow openings and extending flush with an interior surface of the bathtub shell.

14. The bathtub assembly according to 6, wherein the plurality of directed flow jets are configured to direct the directed flow of the liquid within the interior cavity to form a swirling or circulating motion of the liquid within the interior cavity.

15. The bathtub assembly according to claim 6, wherein the dispenser assembly comprises a porous holder configured to contain the substance therein.

16. A method of operating a bathtub assembly, comprising:

providing the bathtub assembly, the bathtub assembly comprising:

a bathtub shell defining an interior cavity configured to contain a volume of liquid, the bathtub shell having at least one dispenser flow opening and a plurality of directed flow openings defined therein;

a circulation system in communication with the interior cavity of the bathtub shell, the circulation system being configured to create a flow of the liquid to and from the interior cavity of the bathtub shell;

a plurality of directed flow jets in fluid communication between the circulation system and the interior cavity of the bathtub shell, the plurality of directed flow jets being configured to convey at least a first portion of the flow of the liquid through the directed flow openings to create a directed flow of the liquid within the interior cavity of the bathtub shell;

a housing in fluid communication between the circulation system and the interior cavity of the bathtub shell, the housing being connected to the bathtub shell at the at least one dispenser flow opening and configured to convey a second portion of the flow of the liquid created by the circulation system into the interior cavity of the bathtub shell through the at least one dispenser flow opening;

a dispenser assembly in fluid communication between the circulation system and the housing, the dispenser assembly being configured to contain a substance therein and to expose the substance to the second portion of the flow of the liquid conveyed to the at least one dispenser flow opening such that the substance is introduced into the volume of liquid in the interior cavity of the bathtub shell via the at least one dispenser flow opening; and a valve positioned in the circulation system, the valve being configured to be operated to allow the second portion of the flow of the liquid created by the circulation system to be directed to the dispenser assembly and the housing;

filling the interior cavity of the bathtub shell with the volume of liquid;

inserting the substance into the dispenser assembly;

activating the circulation system to create the flow of the liquid to and from the interior cavity of the bathtub shell through the directed flow jets to form the directed flow of the liquid within the interior cavity of the bathtub shell; and operating the valve to allow the second portion of the flow of the liquid to pass through the dispenser assembly, the housing, and the at least one dispenser flow opening to introduce the substance to the volume of liquid in the interior cavity of the bathtub shell via the at least one dispenser flow opening.

17. The method according to claim 16, wherein the bathtub assembly further comprises a control panel configured to be operated to control the circulation system and the valve, wherein the step of activating the circulation system comprises actuating a first control on the control panel for controlling the circulation system to create the flow of the liquid to and from the interior cavity, and wherein the step of operating the valve comprises actuating a second control on the control panel for controlling the valve to allow the second portion of the flow of the liquid to be directed to the dispenser assembly and the housing.

18. The method according to claim 17, wherein the control panel is rotatably connected to an upper rim of the bathtub shell, wherein the dispenser assembly comprises a dispenser inlet disposed in the upper rim of the bathtub shell adjacent to the control panel and configured to provide access for placing the substance in the dispenser assembly, and wherein the step of inserting the substance into the dispenser assembly comprises rotating the control panel to a position exposing the dispenser inlet, inserting the substances into the dispenser assembly via the dispenser inlet, and rotating the control panel to a position covering the dispenser inlet.

19. The method according to claim 17, wherein the bathtub assembly further comprises a plurality of lighting features and the control panel is configured to be operated to control the lighting features, and wherein the method further comprises actuating a third control on the control panel for controlling the lighting features to operate the lighting features and to adjust a color and intensity of light emitted by the lighting features.

20. The method according to claim 16, wherein the at least one dispenser flow opening comprises a waterfall opening and the bathtub assembly further comprises a waterfall plenum chamber in fluid communication with the dispenser assembly and the housing, and wherein the dispenser assembly, the waterfall plenum chamber, the housing, and the waterfall opening are configured to form the second portion of the flow of the liquid into a waterfall as the second portion of the flow of the liquid passes through the waterfall opening into the interior cavity of the bathtub shell.

* * * * *